US012758030B2

(12) United States Patent
Pearce

(10) Patent No.: US 12,758,030 B2
(45) Date of Patent: Oct. 13, 2026

(54) FOAM CUSHIONS HAVING AN ORTHOGONAL ALTERNATING STRUCTURE

(71) Applicant: Ziwi LLC, Alpine, UT (US)

(72) Inventor: Tony M. Pearce, Alpine, UT (US)

(73) Assignee: Ziwi LLC, Alpine, UT (US)

( * ) Notice: Subject to any disclaimer, the term of this patent is extended or adjusted under 35 U.S.C. 154(b) by 672 days.

(21) Appl. No.: 18/315,079

(22) Filed: May 10, 2023

(65) Prior Publication Data

US 2023/0363550 A1 Nov. 16, 2023

Related U.S. Application Data

(60) Provisional application No. 63/342,223, filed on May 16, 2022.

(51) Int. Cl.
*A47C 27/15* (2006.01)
*A47C 27/14* (2006.01)

(52) U.S. Cl.
CPC ..... *A47C 27/15* (2013.01); *A47C 27/144* (2013.01); *A47C 27/148* (2013.01)

(58) Field of Classification Search
CPC ..... A47C 27/15; A47C 27/144; A47C 27/148; A47C 27/14; A47C 27/146; A47C 27/20; B32B 2250/42
See application file for complete search history.

(56) References Cited

U.S. PATENT DOCUMENTS 3,222,697 A 12/1965 Scheermesser
4,999,868 A 3/1991 Kraft
5,282,286 A 2/1994 MacLeish
5,322,181 A 6/1994 Nelson
7,334,280 B1 * 2/2008 Swartzburg ..... A47C 21/046 5/724

(Continued)

FOREIGN PATENT DOCUMENTS

CN 201119638 Y 9/2008
CN 103763992 A 4/2014

(Continued)

OTHER PUBLICATIONS

International Searching Authority, International Search Report and the Written Opinion, Sep. 29, 2023.

(Continued)

*Primary Examiner* — Matthew Troutman
*Assistant Examiner* — Alison N Labarge
(74) *Attorney, Agent, or Firm* — Kirton McConkie; Brian Tucker

(57) ABSTRACT

Foam cushions having an orthogonal alternating structure and cushioning articles formed of or containing such foam cushions are provided. The orthogonal alternating structure can be formed by assembling layers of foam and bonding all of or part of the interface where the layers are formed from at least two types or stiffnesses of foam. The layered arrangement of foam can be cut, if necessary, to create a foam cushion where the layers extend along a length or width of the foam cushion, or orthogonal to the direction of the force that the foam cushion is intended to support. Foam cushion components having bases and layers that emanate from the bases could be used to form the foam cushion.

54 Claims, 24 Drawing Sheets

(56) References Cited

U.S. PATENT DOCUMENTS

| | | | | |
|---|---|---|---|---|
| 9,259,099 | B1 * | 2/2016 | Larsen | A47C 27/148 |
| 2006/0260060 | A1 * | 11/2006 | Apperson | A47C 27/15 5/691 |
| 2007/0056116 | A1 | 3/2007 | Galardo | |
| 2010/0072676 | A1 | 3/2010 | Gladney et al. | |
| 2010/0237082 | A1 * | 9/2010 | Fernandez | A47C 27/16 428/152 |
| 2010/0264571 | A1 * | 10/2010 | Tarazona De La Asuncion | A43B 13/181 267/143 |
| 2014/0141171 | A1 | 5/2014 | Callsen et al. | |
| 2014/0208521 | A1 * | 7/2014 | Farnham | A47C 21/042 5/724 |
| 2014/0237728 | A1 * | 8/2014 | Oh | A47C 27/146 5/730 |
| 2019/0008286 | A1 | 1/2019 | Xia et al. | |
| 2021/0259435 | A1 | 8/2021 | Vester et al. | |
| 2022/0095806 | A1 * | 3/2022 | Nguyen | A47C 27/001 |

FOREIGN PATENT DOCUMENTS

| | | | | | |
|---|---|---|---|---|---|
| CN | 211212269 | U * | 8/2020 | | A47C 27/144 |
| CZ | 14034 | U1 | 2/2004 | | |
| DE | 19600435 | A1 * | 7/1997 | | A47C 27/144 |
| DE | 10051747 | A1 * | 5/2002 | | A47C 27/144 |
| DE | 202009006062 | U1 | 7/2009 | | |
| EP | 0734669 | A1 | 10/1996 | | |
| FR | 2685195 | A1 | 6/1993 | | |
| GB | 2300865 | A | 11/1996 | | |
| JP | S51-159210 | U | 6/1975 | | |
| JP | S61-193613 | A | 8/1986 | | |
| JP | 2005-059358 | A | 3/2005 | | |
| JP | 2006095067 | A * | 4/2006 | | A47C 27/144 |
| JP | 2006296461 | A | 11/2006 | | |
| JP | 2007-125099 | A | 5/2007 | | |
| JP | 2015-000319 | A | 1/2015 | | |
| JP | 6150481 | B2 | 6/2017 | | |
| JP | 2018-075366 | A | 5/2018 | | |
| KR | 101602564 | B1 | 3/2016 | | |
| WO | WO-2012123499 | A1 * | 9/2012 | | A47C 27/144 |
| WO | 2013012904 | A1 | 1/2013 | | |
| WO | 2020008401 | A1 | 1/2020 | | |

OTHER PUBLICATIONS

International Preliminary Examining Authority, International Preliminary Report on Patentability, Sep. 20, 2024.

Canadian Intellectual Property Office, Examiner's Report and Search Report, Jun. 30, 2025.

European Patent Office, Extended European Search Report, Mar. 27, 2026.

* cited by examiner

| Test # | $L_H$ | $L_T$ | $L_H/L_T$ | Overall Size | Foam A (Bottom) | Foam B (Top) | Base |
|---|---|---|---|---|---|---|---|
| 1 | 3" | 1" | 3 | 60" x 80" x 3" | 18 ILD, 1.8 lb/ft3 density conventional PU foam | 10 ILD, 4.0 lb/ft3 memory foam | 1" 32 ILD conventional PU foam atop 8" pocketed coil spring |
| 2 | 3" | 1" | 3 | 60" x 80" x 3" | 24 ILD, 1.8 lb/ft3 density conventional PU foam | 10 ILD, 4.0 lb/ft3 memory foam | 1" 32 ILD conventional PU foam atop 8" pocketed coil spring |
| 3 | 3" | 1" | 3 | 60" x 80" x 3" | 32 ILD, 1.8 lb/ft3 density conventional PU foam | 10 ILD, 4.0 lb/ft3 memory foam | 1" 32 ILD conventional PU foam atop 8" pocketed coil spring |
| 4 | 3" | 1" | 3 | 60" x 80" x 3" | 18 ILD, 1.8 lb/ft3 density conventional PU foam | 15 ILD, 2.5 lb/ft3 density Energex | 1" 32 ILD conventional PU foam atop 8" pocketed coil spring |
| 5 | 3" | 1" | 3 | 60" x 80" x 3" | 24 ILD, 1.8 lb/ft3 density conventional PU foam | 15 ILD, 2.5 lb/ft3 density Energex | 1" 32 ILD conventional PU foam atop 8" pocketed coil spring |
| 6 | 3" | 1" | 3 | 60" x 80" x 3" | 32 ILD, 1.8 lb/ft3 density conventional PU foam | 15 ILD, 2.5 lb/ft3 density Energex | 1" 32 ILD conventional PU foam atop 8" pocketed coil spring |
| 7 | 3" | 1" | 3 | 60" x 80" x 3" | 19 ILD Talalay latex foam | 23 ILD, 6.3 lb/ft3 density memory foam | 1" 32 ILD conventional PU foam atop 8" pocketed coil spring |
| 8 | 3" | 1" | 3 | 60" x 80" x 3" | 15 ILD, 2.5 lb/ft3 density Energex | 10 ILD, 4.0 lb/ft3 memory foam | 1" 32 ILD conventional PU foam atop 8" pocketed coil spring |
| 9 | 4" | 1" | 3 | 60" x 80" x 4" | 15 ILD, 2.5 lb/ft3 density Energex | 10 ILD, 4.0 lb/ft3 memory foam | 1" 32 ILD conventional PU foam atop 8" pocketed coil spring |
| 10 | 3" | 1" | 3 | 60" x 80" x 3" | 19 ILD Talalay latex foam | 23 ILD, 6.3 lb/ft3 density memory foam | 1" 32 ILD conventional PU foam atop 8" pocketed coil spring |
| 11 | 4" | 1" | 4 | 60" x 80" x 4" | 19 ILD Talalay latex foam | 23 ILD, 6.3 lb/ft3 density memory foam | 1" 32 ILD conventional PU foam atop 8" pocketed coil spring |
| 12 | 3" | 1" | 3 | 60" x 80" x 3" | 14 ILD Talalay latex foam | 23 ILD, 6.3 lb/ft3 density memory foam | 1" 32 ILD conventional PU foam atop 8" pocketed coil spring |
| 13 | 4" | 1" | 4 | 60" x 80" x 4" | 14 ILD Talalay latex foam | 23 ILD, 6.3 lb/ft3 density memory foam | 1" 32 ILD conventional PU foam atop 8" pocketed coil spring |

FIG. 16

| Test # | Results |
|---|---|
| 1 | Insufficient back support. Immersion is too good, sink through to base, somewhat affecting pressure relief. All properties improved over Foam Type A and Foam Type B as 1.5" slabs one atop another. The conventional foam maintains breathability while the memory foam molds to the body. Excellent motion dampening. |
| 2 | Excellent back support. Immersion is good without sinking through to base. Pressure relief good. All properties improved over Foam Type A and Foam Type B as 1.5" slabs one atop another. The conventional foam maintains breathability while the memory foam molds to the body. Excellent motion dampening. |
| 3 | Excellent back support. Immersion is slightly less than desired, but pressure relief good. All properties improved over Foam Type A and Foam Type B as 1.5" slabs one atop another. The conventional foam maintains breathability while the memory foam molds to the body. Excellent motion dampening. |
| 4 | Insufficient back support. Immersion is too good, sink through to base, somewhat affecting pressure relief. All properties improved over Foam Type A and Foam Type B as 1.5" slabs one atop another. Both foams maintain breathability while the Energex molds to the body. Good motion dampening. |
| 5 | Excellent back support. Immersion is good without sinking through to base. Pressure relief good. All properties improved over Foam Type A and Foam Type B as 1.5" slabs one atop another. Both foams maintain breathability while the Energex molds to the body (quick-rebound memory foam). Good motion dampening. |
| 6 | Excellent back support. Immersion is slightly less than desired, but pressure relief good. All properties improved over Foam Type A and Foam Type B as 1.5" slabs one atop another. Both foams maintain breathability while the Energex molds to the body (quick-rebound memory foam). Good motion dampening. |
| 7 | Excellent back support. Excellent immersion and pressure relief. All properties improved over Foam Type A and Foam Type B as 1.5" slabs one atop another. The latex breathes and also gives a more lively feel than those in the test group that do not include latex while the memory foam molds to the body. The interplay between liveliness in the latex and motion dampening in the memory foam gives a synergystic blend with some properties of each. |
| 8 | Excellent back support. Superior immersion and pressure relief. All properties improved over Foam Type A and Foam Type B as 2.0" slabs one atop another. Excellent motion dampening. The energex maintains breathability. |
| 9 | Good back support. Good immersion and pressure relief. All properties improved over Foam Type A and Foam Type B as 2.0" slabs one atop another. Excellent motion dampening. The energex maintains breathability. |
| 10 | Excellent back support. Excellent immersion and pressure relief. All properties improved over Foam Type A and Foam Type B as 1.5" slabs one atop another. Good motion dampening from the memory foam without killing the liveliness from the latex foam |
| 11 | Excellent back support. Excellent immersion and pressure relief. All properties improved over Foam Type A and Foam Type B as 1.5" slabs one atop another. Good motion dampening from the memory foam without killing the liveliness from the latex foam |
| 12 | Excellent back support. Superior immersion and pressure relief. All properties improved over Foam Type A and Foam Type B as 1.5" slabs one atop another. Good motion dampening from the memory foam without killing the liveliness from the latex foam. |
| 13 | Excellent back support. Superior immersion and pressure relief. All properties improved over Foam Type A and Foam Type B as 2.0" slabs one atop another. Good motion dampening from the memory foam without killing the liveliness from the latex foam. |

FIG. 16
(Continued)

| Test # | Height | $L_H$ | $L_T$ | $L_H/L_T$ | Overall Size | Foam A (bottom) | Foam B (top) | Base |
|---|---|---|---|---|---|---|---|---|
| 14 | 10" | 5.5" | 1.5" | 3.7 | 60" x 80" x 10" | 55 ILD, 1.8 lb/ft3 density conventional PU foam. $B_H$ is 1.25". | 18 ILD, 1.8 lb/ft3 density conventional PU foam. $B_H$ is 3.25". | None. (Tested as the entire mattress) |
| 15 | 10" | 5.5" | 1.5" | 3.7 | 60" x 80" x 10" | 55 ILD, 1.8 lb/ft3 density conventional PU foam. $B_H$ is 1.25". | 22 ILD, 2.5 lb/ft3 density Energex. $B_H$ is 3.25". | None. (Tested as the entire mattress) |
| 16 | 8" | 6" | 1.5" | 4 | 60" x 80" x 8" | 55 ILD, 1.8 lb/ft3 density conventional PU foam. $B_H$ is 1". | 18 ILD, 1.8 lb/ft3 density conventional PU foam. $B_H$ is 1". | None. (Tested as a base) |

FIG. 17

| Test # | Results |
|---|---|
| 14 | As a whole mattress, excellent back support and excellent pressure relief. All foams breathe well. Good motion dampening. |
| 15 | As a whole mattress, excellent back support and excellent pressure relief, with a somewhat more plush feel than test 14 that has 18 ILD conventionall PU foam in place of the Energex foam in this test. Good motion dampening and both foams breath well. |
| 16 | Superior as a base to the pocketed coil springs topped by 1" foam in that used beneath any of a variety of mattress comfort layers, it increases (compared to the springs) pressure relief and elevates back support. Also very superior to a single homogenous base foam layer with an ILD that is an average of the ILDs . In this case, the average of the 55 and 18 ILD foams average to 36.5 ILD, and so the 55/18-ILD base was compared to a homogenous 36-ILD base under various mattress cushioning layers. The homogenous base felt hard and uncomfortable, with increased pressure at the hip and shoulder of the user and decreased back support because the non-immersion of the hip and shoulder caused the torso to sag in order to reach needed support. Good motion dampening. Both foams breath well. |

FIG. 17
(Continued)

| Test # | Height | $L_H$ | $L_T$ | $L_H/L_T$ | Overall Size | Foam A (Bottom) | Foam B (Top) | Base |
|---|---|---|---|---|---|---|---|---|
| 17 | 4" | 3" | 1" | 3 | 60" x 80" x 4" | 15 ILD, 2.5 lb/ft3 density Energex. $B_H$ is 0.5". | 24 ILD, 1.8 lb/ft3 density conventional PU foam. $B_H$ is 0.5". | Cushion from Test 16 |
| 18 | 4" | 3" | 1" | 3 | 60" x 80" x 4" | 4 lb/ft3 extra-doughy-feel custom memory foam. $B_H$ is 0.5". | 24 ILD, 1.8 lb/ft3 density conventional PU foam. $B_H$ is 0.5". | Cushion from Test 16 |
| 19 | 5" | 4" | 1" | 4 | 60" x 80" x 5" | 15 ILD, 2.5 lb/ft3 density Energex. $B_H$ is 0.5". | 32 ILD, 1.8 lb/ft3 density conventional PU foam. $B_H$ is 0.5". | Cushion from Test 16 |
| 20 | 5" | 4" | 1" | 4 | 60" x 80" x 5" | 4 lb/ft3 extra-doughy-feel custom memory foam. $B_H$ is 0.5". | 22 ILD, 2.5 lb/ft3 density Energex. $B_H$ is 0.5". | Cushion from Test 16 except with foam B being 22 ILD, 2.5 lb/ft3 density Energex |
| 21 | 5" | 4" | 1" | 4 | 60" x 80" x 5" | 22 ILD, 2.5 lb/ft3 density Energex. $B_H$ is 0.5". | 24 ILD Talalay latex foam. $B_H$ is 0.5". | Cushion from Test 16 except with foam B being 22 ILD, 2.5 lb/ft3 density Energex |
| 22 | 5" | 4" | 1" | 4 | 60" x 80" x 5" | 4 lb/ft3 extra-doughy-feel custom memory foam. $B_H$ is 0.5". | 24 ILD Talalay latex foam. $B_H$ is 0.5". | Cushion from Test 16 except with foam B being 22 ILD, 2.5 lb/ft3 density Energex |

FIG. 18

| Test # | Results |
|---|---|
| 17 | Excellent pressure relief and back support. Excellent immersion. Remarkably softer than a mattress made of homogeneous horizontal slabs of the same foams atop one another. Even though very soft, it has firm and even pressure support under the torso. Very good motion dampening. All foams in this test breathe well. |
| 18 | Excellent pressure relief and back support. Excellent immersion. Remarkably softer than a mattress made of homogeneous horizontal slabs of the same foams atop one another. Even though very soft, it has firm and even pressure support under the torso. Conventional foam maintains breathability (the mattress demonstrates nearly no heat trapping) while the memory foam molds to the body over time without losing back support due to the conventional foam maintaining that support. Excellent motion dampening. |
| 19 | Superior pressure relief and back support. Superior immersion. Remarkably softer than a mattress made of homogeneous horizontal slabs of the same foams atop one another. Even though very soft, it has firm and even pressure support under the torso. All of the foams used maintains breathability. Excellent motion dampening. |
| 20 | Superior pressure relief and back support. Superior immersion. Remarkably softer than a mattress made of homogeneous horizontal slabs of the same foams atop one another. Even though very soft, it has firm and even pressure support under the torso. Conventional foam maintains breathability while the memory foam molds to the body over time without losing back support due to the Energex foam maintaining that support. |
| 21 | Superior pressure relief and back support. Superior immersion. Remarkably softer than a mattress made of homogeneous horizontal slabs of the same foams atop one another. Even though very soft, it has firm and even pressure support under the torso. All the foams in this mattress breathe. The latex gives a more lively feel than those in the test group that do not include latex (some users prefer liveliness to dampening of motion). Fair motion dampening. |
| 22 | Superior pressure relief and back support. Superior immersion. Remarkably softer than a mattress made of homogeneous horizontal slabs of the same foams atop one another. Even though very soft, it has firm and even pressure support under the torso. The latex foam (along with the Energex and conventional foam) maintains breathability while the memory foam molds to the body over time without losing back support due to the Energex foam maintaining that support. Good motion dampening considering the inclusion of lively latex. |

FIG. 18
(Continued)

| Test # | Height | $L_H$ | $L_T$ | $L_H/L_T$ | Overall Size | Foam A (bottom) | Foam B (top) |
|---|---|---|---|---|---|---|---|
| 23 | 4.5" | 3.5" | 1" | 3.5 | 24" x 16" x 4.5" | 8 ILD, 1.8 lb/ft3 density conventional PU foam | 10 ILD, 2.5 lb/ft3 density Energex |
| 24 | 6" | 4.5" | 1" | 4.5 | 24" x 16" x 6" | 8 ILD, 1.8 lb/ft3 density conventional PU foam | 10 ILD, 2.5 lb/ft3 density Energex |
| 25 | 4.5" | 3.5" | 1" | 3.5 | 24" x 16" x 4.5" | 9 ILD Talalay latex foam | 10 ILD, 2.5 lb/ft3 density Energex |
| 26 | 6" | 4.5" | 1" | 4.5 | 24" x 16" x 6" | 9 ILD Talalay latex foam | 10 ILD, 2.5 lb/ft3 density Energex |

FIG. 19

| Test # | Results |
|---|---|
| 23 | Soft and very pressure relieving, but also very supportive, with enough immersion to lower overall average pressure but not so much as to bear on sensitive areas such as the eye of the user when side sleeping. Each side gives a slightly different feel so that user can choose, perhaps even flipping it during the night if wanted. Both sides breathe well. These described properties are very different from a pillow that had solid slabs of Foam A and Foam B (one on each side), which instead would feel like the pillow is made all of the material of the upward half. For users preferring a medium-thickness pillow. |
| 24 | Soft and very pressure relieving, but also very supportive, with enough immersion to lower overall average pressure but not so much as to bear on sensitive areas such as the eye of the user when side sleeping. Each side gives a slightly different feel so that user can choose, perhaps even flipping it during the night if wanted. Both sides breathe well. These described properties are very different from a pillow that had solid slabs of Foam A and Foam B (one on each side), which instead would feel like the pillow is made all of the material of the upward half. For users preferring a thick pillow. |
| 25 | Very soft and exceptionally pressure relieving, but also very supportive, with enough immersion to lower overall average pressure but not so much as to bear on sensitive areas such as the eye of the user when side sleeping. Each side gives a slightly different feel so that user can choose, perhaps even flipping it during the night if wanted. Both sides breathe well. These described properties are very different from a pillow that had solid slabs of Foam A and Foam B (one on each side), which instead would feel like the pillow is made all of the material of the upward half. For users preferring a medium-thickness pillow. |
| 26 | Very soft and exceptionally pressure relieving, but also very supportive, with enough immersion to lower overall average pressure but not so much as to bear on sensitive areas such as the eye of the user when side sleeping. Each side gives a slightly different feel so that user can choose, perhaps even flipping it during the night if wanted. Both sides breathe well. These described properties are very different from a pillow that had solid slabs of Foam A and Foam B (one on each side), which instead would feel like the pillow is made all of the material of the upward half. For users preferring a thick pillow. |

FIG. 19
(Continued)

FOAM CUSHIONS HAVING AN ORTHOGONAL ALTERNATING STRUCTURE

CROSS-REFERENCE TO RELATED APPLICATIONS

This application claims the benefit of U.S. Provisional Appl. No. 63/342,223 which was filed on May 16, 2022.

BACKGROUND

Foam is commonly used as a cushioning material in a variety of applications. For example, mattresses are commonly formed of memory foam due to its ability to mold to the body to provide even support. However, memory foam also has various undesirable properties. Many individuals complain that memory foam feels dead, meaning that it tends to absorb force as opposed to springing back as would a traditional spring mattress or a conventional polyurethane non-memory foam. It can also be difficult to roll over on a memory foam mattress due to the indentation that is formed around the body. Additionally, memory foam has minimal breathability and is therefore too hot for many individuals.

To address such disadvantages of foam, and particularly memory foam, other materials have been used for mattresses and other cushioning articles. For example, mattresses, such as those marketed under the Purple trademark, have been formed of a gelatinous material having an adjoining hollow column shape. Mattresses made of this gelatinous material provide local instability and general stability due to the columns' ability to buckle where needed such as under an individual's hip. However, such mattresses are extremely heavy and require specialized manufacturing.

BRIEF SUMMARY

The present invention extends to foam cushions having an orthogonal alternating structure and to cushioning articles formed of or containing such foam cushions. The orthogonal alternating structure can be formed by bonding together layers of foam where the layers are formed from at least two types or stiffnesses of foam. The layered arrangement of foam can be cut, if necessary, to create a foam cushion where the layers extend along a length or width of the foam cushion, or orthogonal to the direction of the force that the foam cushion is intended to support. Foam cushion components having bases and layers that emanate from the bases could be used to form the foam cushion.

In some embodiments, the present invention may be implemented as a foam cushion that includes layers of foam that are arranged along a length of the foam cushion.

In some embodiments, the present invention may be implemented as a cushioning article that includes a first foam cushion. The first foam cushion may include layers of foam that are arranged along a length of the foam cushion.

In some embodiments, the present invention may be implemented as a method for manufacturing a mattress. Sheets of foam can be stacked along an axis to form a layered foam block. The layered foam block can be cut along the axis to form a foam cushion comprising layers of foam. The foam cushion can be oriented within the mattress to cause layers of foam to be arranged along a length of the mattress.

In some embodiments, the present invention may be implemented as a method for manufacturing a foam cushion. A first piece of foam and a second piece of foam can be created in a desired shape. The first piece of foam and the second piece of foam can be cut into corresponding layers. Alternating layers of the first piece of foam and the second piece of foam can be bonded together to form the desired shape.

In some embodiments, the present invention may be implemented as a method for assembling a foam cushion. A first foam cushion component that includes a base and layers that emanate from the base can be obtained. A second foam cushion component that includes a base and layers that emanate from the base can be obtained. The layers of the first foam cushion component can be inserted between the layers of the second foam cushion component to form the foam cushion.

This summary is provided to introduce a selection of concepts in a simplified form that are further described below in the Detailed Description. This Summary is not intended to identify key features or essential features of the claimed subject matter.

BRIEF DESCRIPTION OF THE DRAWINGS

Understanding that these drawings depict only typical embodiments of the invention and are not therefore to be considered limiting of its scope, the invention will be described and explained with additional specificity and detail through the use of the accompanying drawings in which:

FIGS. 16-18 are tables that summarize results of experiments that were performed to test embodiments of the present invention.

DETAILED DESCRIPTION

In this specification and the claims, the term "cushioning article" is intended to encompass mattresses, pillows, couches, car seats, aircraft seats, after-market seat cushions, and other furniture or articles that provide cushioning to an individual. A cushioning article may include one or more foam cushions configured in accordance with one or more embodiments of the present invention. A foam cushion configured in accordance with embodiments of the present invention may also be separate and/or independent from a cushioning article and may be covered with a fabric or plastic film or other pliable covering. The term "approximately" means within 10% of the stated value.

In accordance with embodiments of the present invention, a foam cushion can be formed of layers of foam that have an orthogonal alternating structure. In this context, the term "orthogonal" is intended to represent that the layers are arranged along an axis that is orthogonal to the force that the foam cushion is intended to support. The term "alternating" is intended to represent that the layers are formed from alternating types or stiffnesses of foam.

Figure 1A:
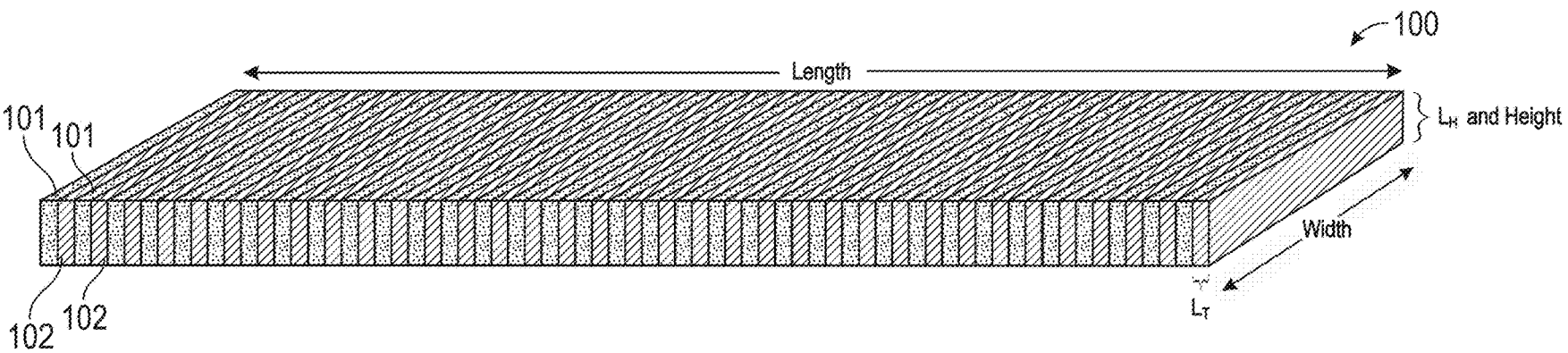
FIGS. 1A and 1B are side perspective and side views respectively of a foam cushion having an orthogonal alternating structure in accordance with one or more embodiments of the present invention.
Figure 1B:
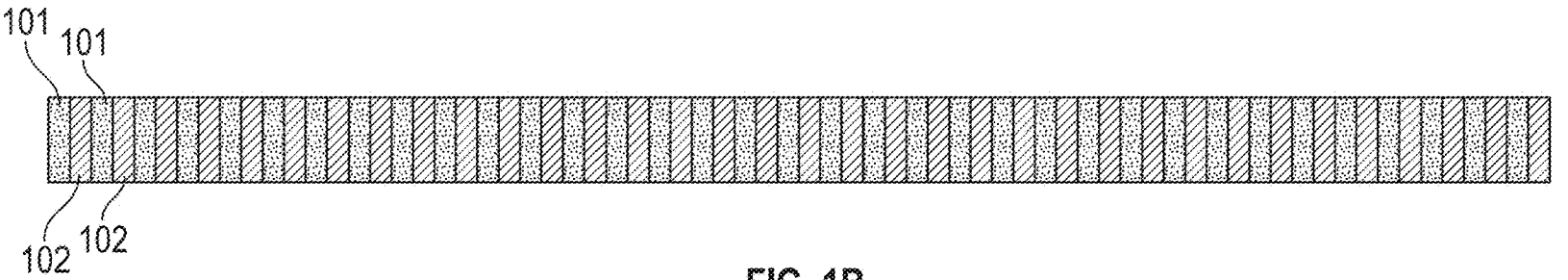

FIGS. 1A and 1B provide an example of a foam cushion 100 that has an orthogonal alternating structure. Foam cushion 100 has a rectangular shape which is labeled as having a length, a width, and a height. The height can be considered the vertical dimension when foam cushion 100 is lying flat, whereas the length and width can be considered the horizontal dimensions. Foam cushion 100 is formed of two types of foam which are arranged into alternating layers 101 and 102 along the length of the foam cushion (the length need not be longer than the width). Accordingly, the combined thickness of all layers 101 and 102 defines the total length of foam cushion 100. In this embodiment, the width of each layer 101 and 102 defines a consistent width of foam cushion 100, but the layers could have different widths in some embodiments (e.g., to create non-rectangular-shaped foam cushions). In this embodiment, the height ($L_H$) of each layer 101 and 102 defines a consistent height of foam cushion 100, but the layers could have different heights or could be arranged in different vertical positions relative to one another as described below.

The thickness ($L_T$) of each layer 101, 102 (i.e., the dimension of the layer along the length of foam cushion 100) can be less than the height of each layer to thereby create local instability. In other words, this smaller thickness can cause each layer 101, 102 to collapse more easily under a downward force such as from an individual's hip or shoulder when lying on foam cushion 100. However, the combination of layers 101 and 102 can still provide general stability across foam cushion 100. For example, if foam cushion 100 is a mattress, individual layers 101 and 102 can collapse under localized pressure from an individual's hip and shoulder while the combination of layers 101 and 102 extending across a broader portion of the body such as the torso can exhibit general stability to provide back support.

Because layers 101 can be formed of a different type of foam from layers 102, foam cushion 100 can exhibit synergistic benefits relative to the use of a single type of foam or a different structural arrangement of foams. Stated another way, the type of foam for layers 101 can have a first set of properties and the type of foam for layers 102 can have a second set of properties, and the orthogonal alternating structure of these layers can cause the first and second set of properties to yield synergistic benefits. For example, layers 101 could be formed of a relatively stiff foam and layers 102 could be formed of a relatively soft foam such that each layer will collapse/compress differently from the adjacent layer. As other examples, layers 101 and 102 could have different breathability, bounce-back, and/or softness.

The ratio between the height of each layer ($L_H$) and the thickness of each layer ($L_T$) can be selected to achieve a desired instability of the layers under significant pressure (e.g., due to the hips or shoulders when an individual lies on a mattress). In some embodiments, this ratio may be at least 2.5, at least 3.0, at least 3.5, at least 4.0, at least 4.5, or higher. A higher ratio may cause the layers to exhibit greater instability, or in other words, to collapse under pressure to better form to an individual's body.

The IFD of the foams used for each layer may also be selected to achieve a desired instability. For example, alternating layers of higher IFD foam with layers of lower IFD foam may make it easier for the layers of higher IFD foam to buckle because the layers of lower IFD foam do not provide significant resistance to such buckling (i.e., the layers of lower IFD foam may compress to accommodate the buckling of the layers of higher IFD foam).

The layered structure of a foam cushion configured in accordance with embodiments of the present invention allow this instability to occur only in response to sufficient loading/pressure. Accordingly, a mattress configured in accordance with embodiments of the present invention may be giving only under the hips or shoulders while remaining firm under the other parts of the body.

As one particular example, foam cushion 100 could represent a mattress or a portion of a mattress, and layers 101 could be formed of latex foam (or latex foam rubber) while layers 102 could be formed of memory foam. In such cases, the latex foam can give the mattress some properties desired in a mattress, such as breathability, bounce-back when shifting places on the mattress, and softness. Memory foam lacks these properties. It is known for feeling 'dead' when lying down or doing other activities on a mattress. It is also known for making it hard to roll over on the mattress since it creates a body shaped depression that takes some time to return to original shape. It is also known for not being very breathable, so that the person lying on the mattress gets hot from body heat or vapor that cannot escape. It does not have the amazing softness of latex foam (e.g., talalay latex foam rubber). Memory foam can also lack back support, since when the body heats up the memory foam, it becomes softer, and a body's heavy torso can sag into that softness. Memory foam does have positive properties, however, that latex foam lacks, the most significant of which is that memory foam is known for molding itself to the shape of the body over time, giving a more even support to the body (relief from pressure points). So, alternating layers of memory foam with layers of latex foam can be synergistic. The latex foam instantly tends to spring to shape, which would hasten the memory foam's return to shape after deformation, and would feel much more lively (as opposed to memory foam's deadness). Latex foam is more breathable, and the body's heat and vapors can escape through the intermittent latex foam layers. The softness of latex foam gives the mattress a much softer 'hand feel' to the mattress, and overcomes memory foam's initial hard feel which exists during the time when the memory foam is heating up to body temperature and slowly forming to the body. The latex foam's springy nature will help to offset the loss of support when the memory foam heats up and becomes softer. The alternating layers of memory foam add to the synergy by enhancing the shape-to-fit properties which reduces pressure points. These synergistic benefits combined with the benefit of local instability and general stability can yield a highly-desirable mattress or other foam cushion.

In some embodiments, a foam cushion can have more than two types of foams arranged in layers. Using the above example, layers of reticulated foam could be used with layers of memory foam and layers of latex foam to provide higher breathability. As another example, if more firmness is desired or if the spring-back to shape of the adjacent memory foam needs to be faster, a soft talalay latex in the above example can be replaced with a stiffer latex, generally made by the dunlop process rather than the talalay process. Although each layer 101 and 102 is represented as being formed from a single piece of foam, in some embodiments, a layer 101 or layer 102 could be formed from multiple pieces of the same foam.

A wide variety of foams could be used in embodiments of the present invention. The foams include, but are not limited to: quick-rebound polyurethane foam (selected from the group comprising conventional polyurethane foam, high resiliency polyurethane foam, and reticulated polyurethane foam), slow-rebound polyurethane foam (selected from the group comprising slower-rebound memory foam, quicker-rebound memory foam, and gel memory foam), latex foam (selected from the group comprising natural latex foam, organic natural latex foam, synthetic latex foam, and part natural part synthetic latex foam), expanded polyolefin foam, EVA foam, silicone foam, melamine foam, PVDF foam, polyethylene foam, shredded and then rebonded foam (comprising any shredded flexible foam types), Energex® foam (a unique foam made by Elite Comfort Solutions which is a highly breathable, somewhat viscoelastic foam that changes when warmed to body temperature from its original viscoelastic [memory] foam to a bouncy foam with resilience similar to latex), etc. Foams with different stiffnesses are intended to encompass, but not be limited to, using conventional polyurethane open-cell cushioning foams with stiffnesses of IFD (Indentation Force Deflection) 8, IFD 13, IFD 18, IFD 24, IFD 32, IFD 36, IFD 44, IFD 55, and IFD 60 or equivalents thereto. In embodiments of the present invention, either the type of foam may be different in one layer adjacent to the next, or the stiffness of the foam is different in one layer adjacent to the next, or both. Two or more types of foam can be selected for synergy of properties with the adjacent layer, and the two or more stiffnesses of foam may be selected to create stability under broad areas of the body or other cushioned object and instability under the pointy areas of the body or other cushioned object. Results can be more pronounced if the adjacent foams differ in both type and stiffness.

Figure 2A:
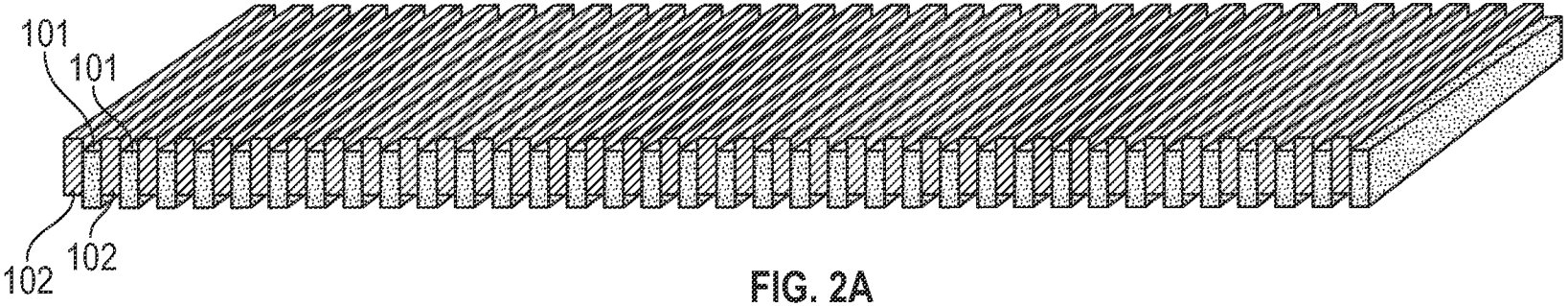
FIGS. 2A and 2B are side perspective and side views respectively of another foam cushion having an orthogonal alternating structure in accordance with one or more embodiments of the present invention.
Figure 2B:
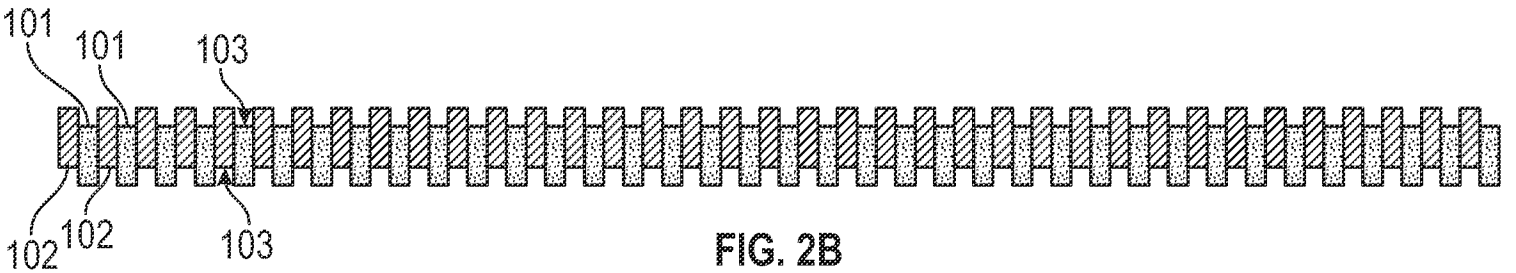

FIGS. 2A and 2B provide another example of a foam cushion 200 that has an orthogonal alternating structure. In foam cushion 200, layers 101 are vertically offset relative to layers 102 thereby forming gaps 103 at the top and bottom of foam cushion 200. In the depicted embodiments, gaps 103 are formed at the top of foam cushion 200 between adjacent pairs of layers 102 and gaps 103 are formed at the bottom of foam cushion 200 between adjacent pairs of layers 101.

Figure 3A:
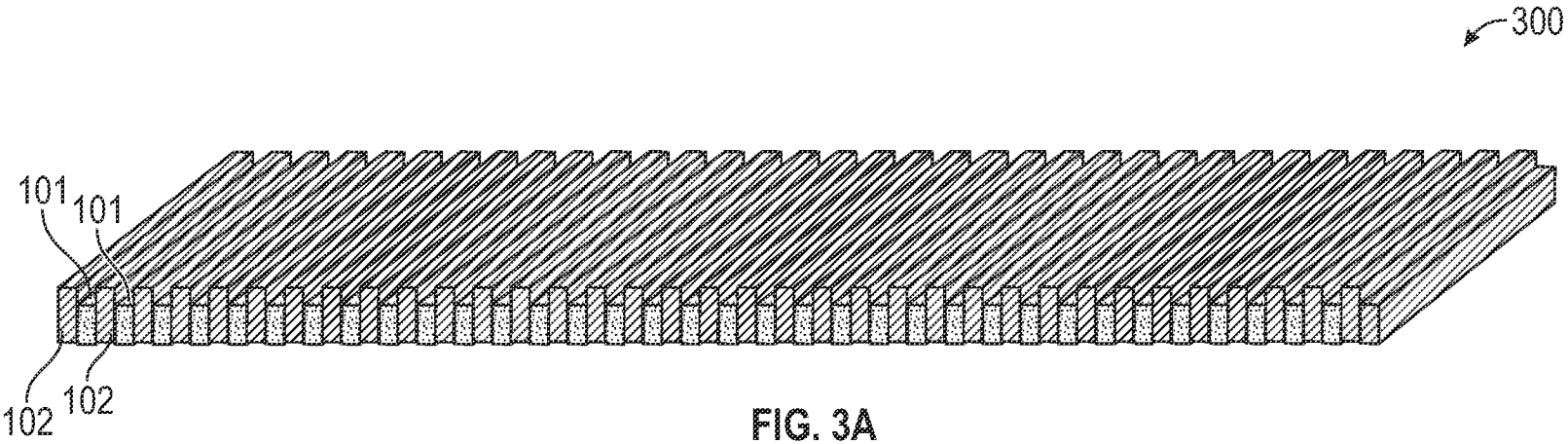
FIGS. 3A and 3B are side perspective and side views respectively of another foam cushion having an orthogonal alternating structure in accordance with one or more embodiments of the present invention.
Figure 3B:
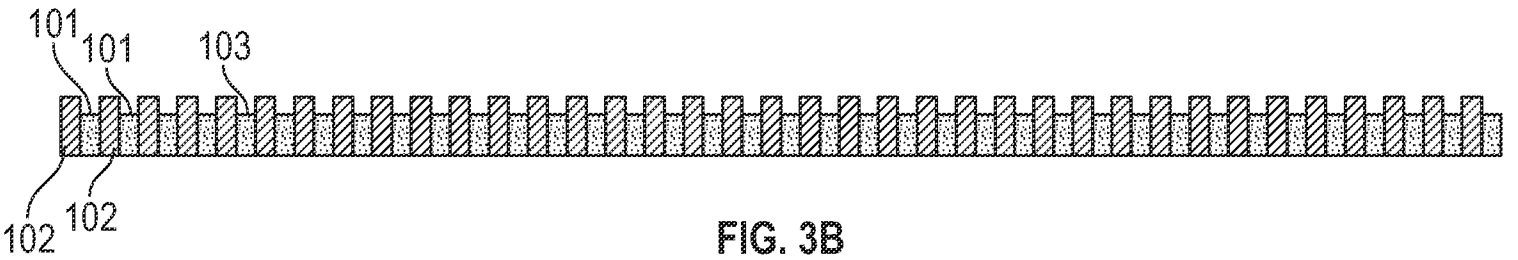

FIGS. 3A and 3B provide another example of a foam cushion 300 that has an orthogonal alternating structure. In foam cushion 300, layers 102 have a different height than (i.e., are taller than) layers 101 thereby forming gaps 103 at the top of foam cushion 300 (or at the bottom if foam cushion 300 is flipped over) between adjacent pairs of layers 102.

In both foam cushion 200 and foam cushion 300, gaps 103 form air pockets that can provide more breathability, less overall stiffness, less initial stiffness during the initial descent of the body or other cushioned object into the foam cushion, and reduced foam cost.

Figure 4:
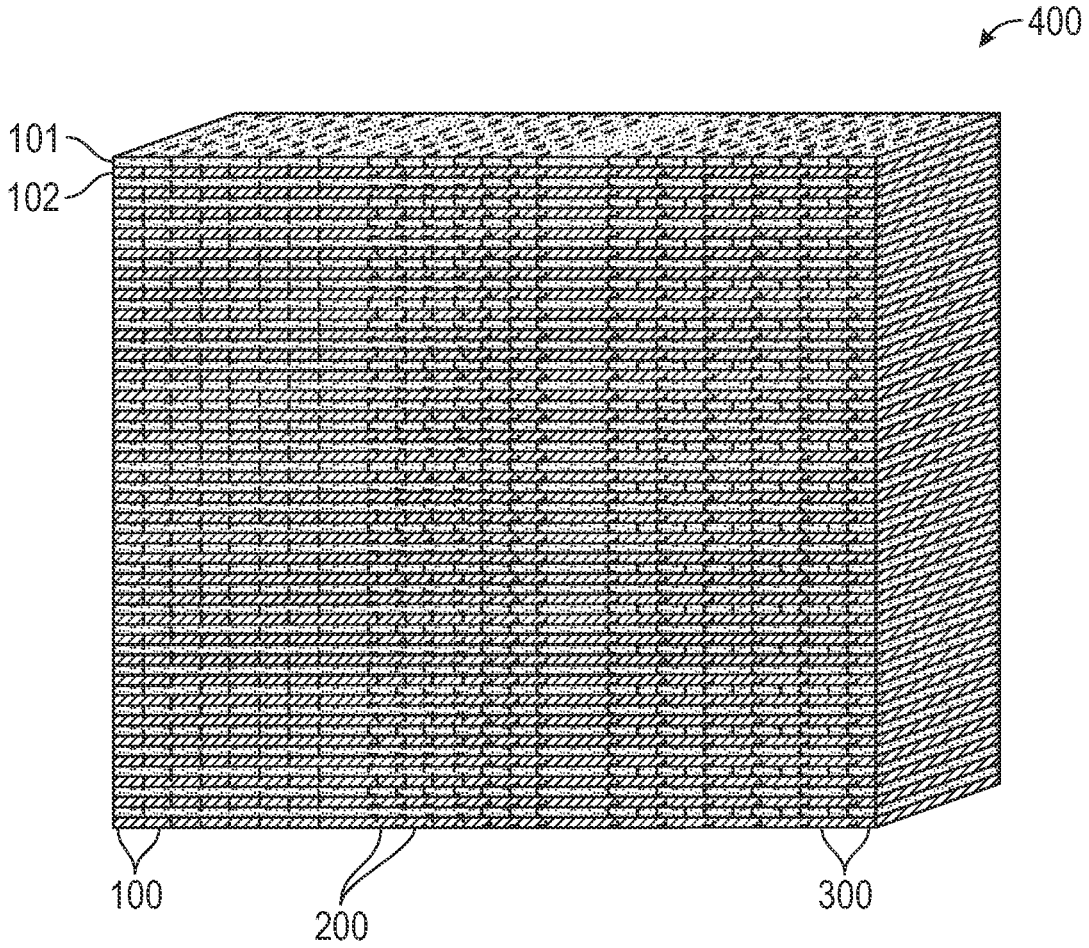
FIG. 4 provides an example of how foam cushions having an orthogonal alternating structure could be formed in accordance with one or more embodiments of the present invention.

FIG. 4 provides an example of how foam cushions 100, 200, and 300 could be cut from a layered foam block 400. For example, sheets of different types and/or stiffnesses of foam could be alternately stacked and bonded together to create layered foam block 400. Layered foam block 400 could then be cut (e.g., using a CNC band saw) with a desired pattern to produce foam cushions 100, 200, and/or 300. By cutting foam cushions 100, 200, and/or 300 from layered foam block 400, foam waste, labor, and time can be minimized. In some embodiments, the foam can be bonded together using a flexible or stretchable adhesive with precisely controlled thickness to prevent the bond from creating too much localized stiffness. It should be noted that in one embodiment, when foam cushion 300 is cut in the pattern shown in FIG. 4, half of the resulting cushions 300 have the higher portion of the first type or stiffness of foam and the other half of the resulting cushions 300 have the higher portion of the second type or stiffness of foam. It is also possible to shift the cut by half a layer so that the higher portions and the lower portions each have 50% of the first type or stiffness of foam and 50% of the second type or stiffness of foam. This shifted cut would make it so that all of the foam cushions 300 were essentially identical, whereas the non-shifted cut would result in two different foam cushions 300 which may then go into separated cushion designs. For example, with the non-shifted cut where the higher portions were latex foam and the lower portions were memory foam, more of the latex foam properties may be exhibited than the memory foam properties. As another example, with the non-shifted cut where the higher portions were memory foam and the lower portions were latex foam, more of the memory foam properties may be exhibited than the latex foam properties.

Figure 5A:
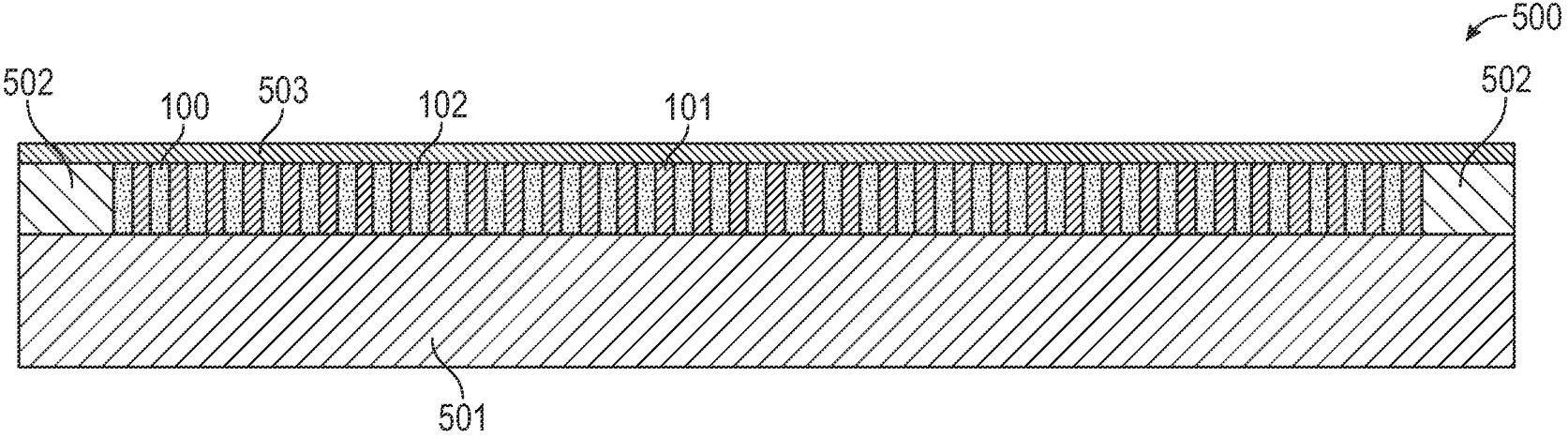
FIGS. 5A-5D are each cross-sectional side views of a mattress that includes a foam cushion having an orthogonal alternating structure in accordance with one or more embodiments of the present invention.
Figure 5B:
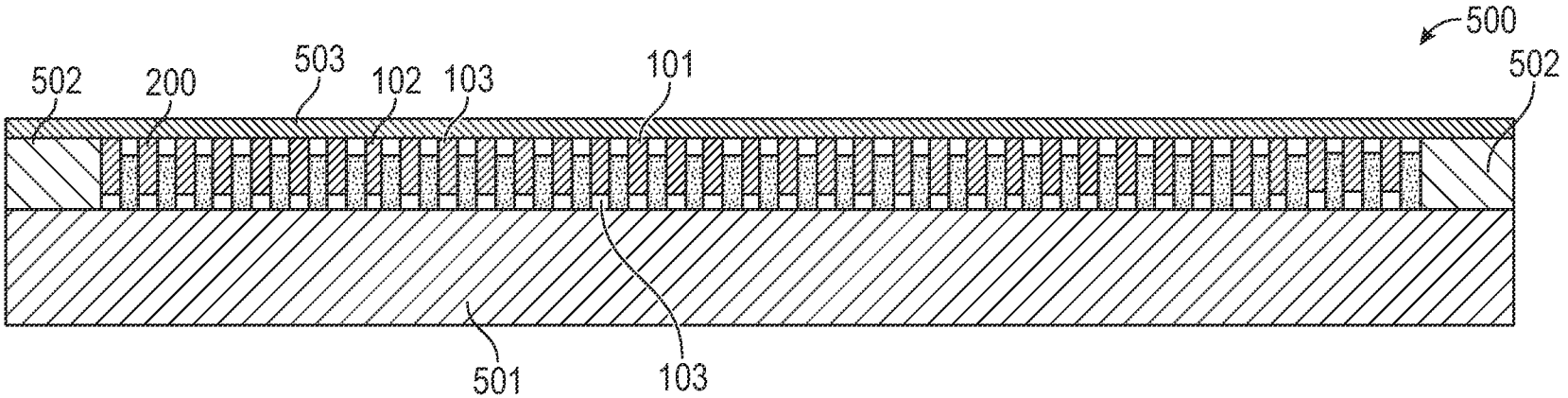
Figure 5C:
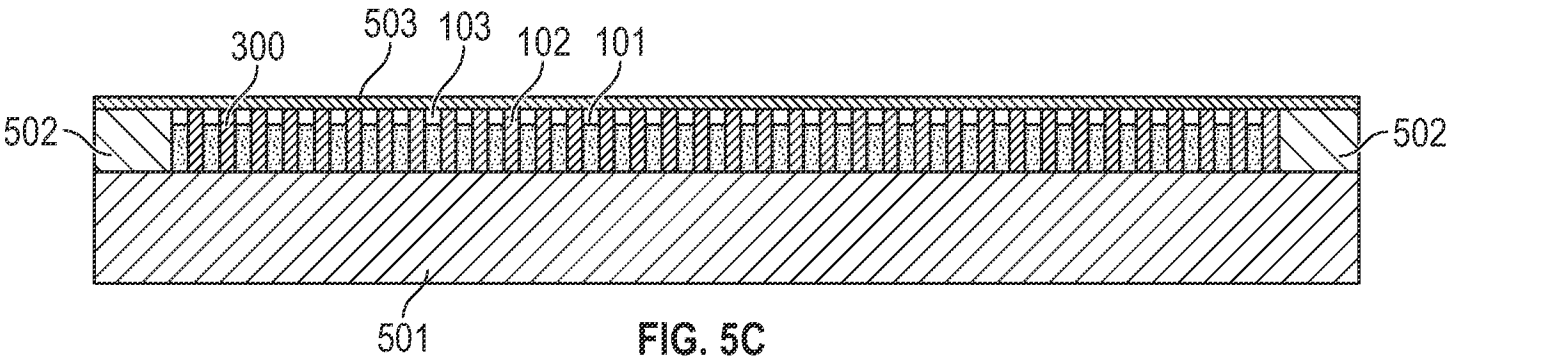
Figure 5D:
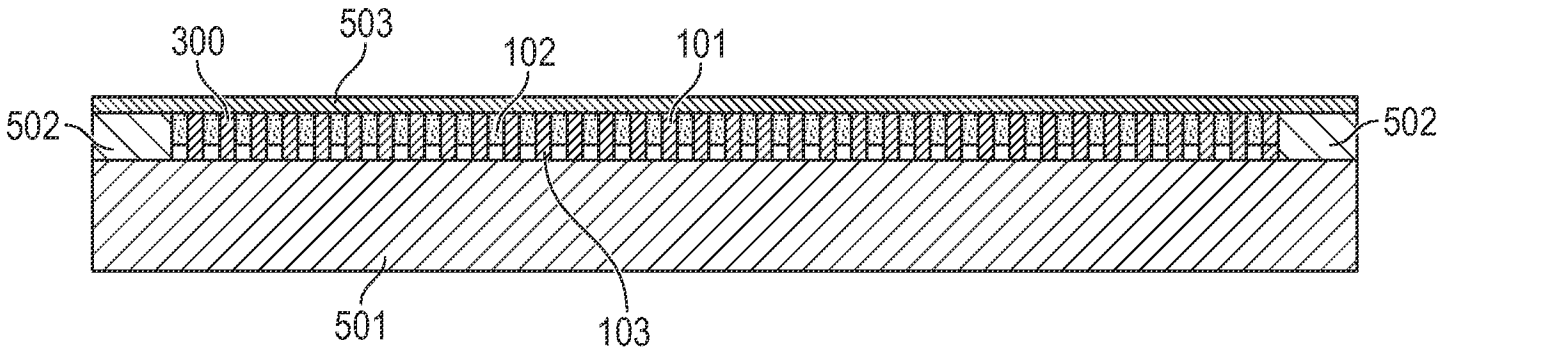
Figure 6:
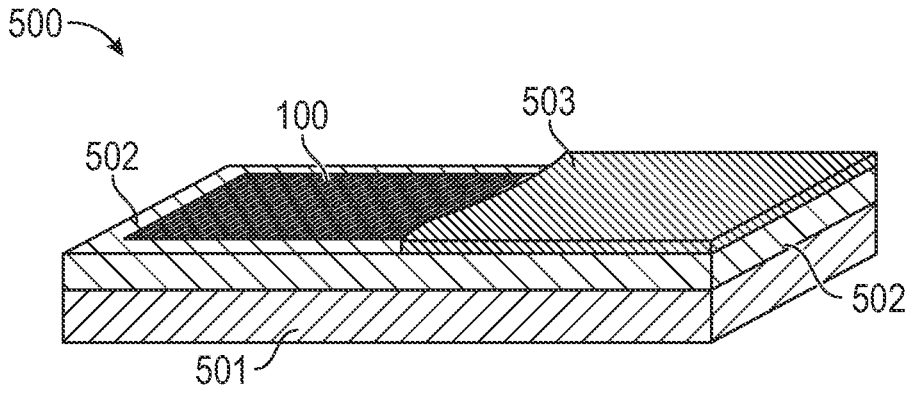
FIG. 6 is a cutaway, perspective top view of a mattress that includes a foam cushion having an orthogonal alternating structure in accordance with one or more embodiments of the present invention.

FIGS. 5A-5D, which are cross-sectional views, provide examples of how foam cushions 100, 200, and 300 can be integrated into a mattress 500. In each example, foam cushion 100, 200, or 300 is supported on top of a base layer 501 and surrounded by a side layer 502. A top layer 503 can be positioned on top of the side layer 502 and foam cushion 100, 200, or 300. In FIG. 5A, mattress 500 includes foam cushion 100 which has the same height as side layer 502 such that no air pockets are formed. In FIG. 5B, mattress 500 includes foam cushion 200 which has the same height as side layer 502 so that gaps 103 are formed towards base layer 501 and towards top layer 503. In FIG. 5C, mattress 500 includes foam cushion 300 which has the same height as side layer 502 with gaps 103 being oriented towards top layer 503. In FIG. 5D, mattress 500 includes foam cushion 300 but gaps 103 are oriented towards base layer 501. Notably, a mattress could also be formed with foam cushion 100, 200, or 300 but without any or all of base layer 501, side layer 502, and top layer 503. FIG. 6 is a cutaway perspective view of mattress 500 as configured in FIG. 5A or FIG. 5D.

Figure 7:
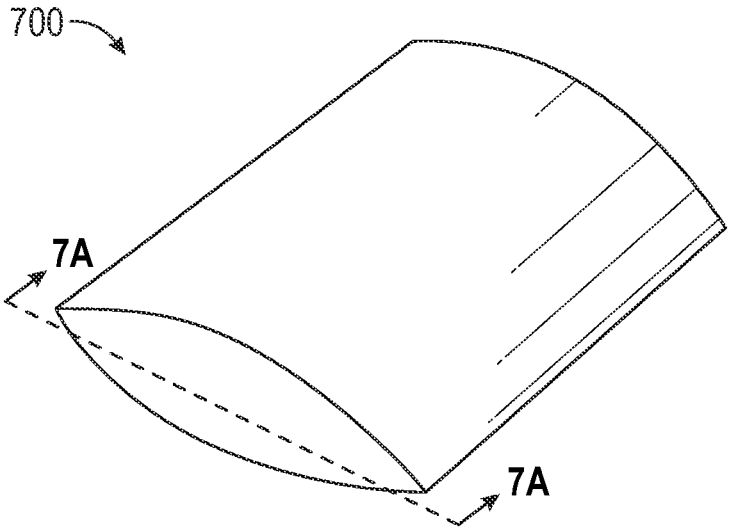
FIGS. 7 and 7A-7C provide an example of how non-rectangular foam cushions having an orthogonal alternating structure could be formed in accordance with one or more embodiments of the present invention.

FIGS. 7 and 7A-7C illustrate another technique that could be employed to produce a foam cushion that is configured in accordance with embodiments of the present invention. This technique is particularly suitable for producing foam cushions that do not have a rectangular cross-sectional shape such as a pillow or a car seat. FIG. 7 illustrates a piece of foam 700 that is shaped like a pillow. Notably, at least two pieces of foam 700 having different properties should be used (i.e., two different types and/or stiffnesses of foam as described above) and could be molded into the desired shape for a foam cushion.

Figure 7B:
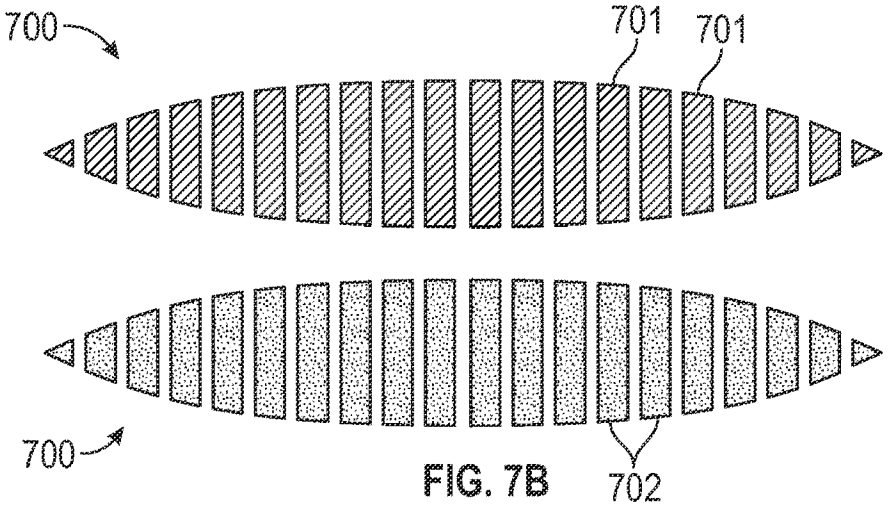
Figure 7A:
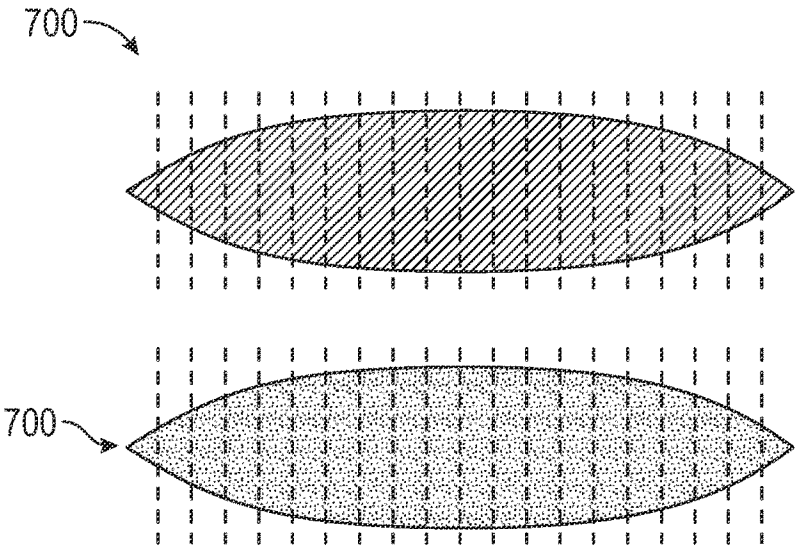
Figure 7C:
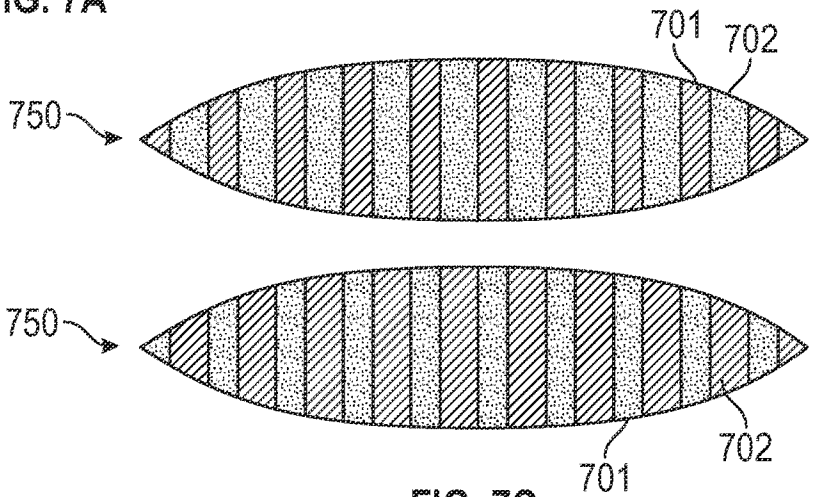

FIG. 7A is a side view of two pieces of foam 700 and represents how these pieces of foam 700 could be cut to produce layers 701 and 702 shown in FIG. 7B. Each piece of foam 700 can be cut in a similar manner such that the set of layers 701 have the same shape and size as layers 702. Then, as represented in FIG. 7C, layers 701 and 702 can be bonded together to form the orthogonal alternating structure described above thereby yielding two foam cushions 750. Foam cushions 750 have the same general shape as pieces of foam 700, however, this need not be the case such as when less than all of layers 701 or 702 are used.

Non-rectangular foam cushions could also be created using the technique represented in FIG. 4 by performing one or more cuts to create the desired shape (e.g., rounded edges, tapered edges, buckets or other indentations, etc.). This can be done by, for example, band sawing block/stack 400 from two sides. In one embodiment, a bed pillow that tapers from its center in all four directions (a standard pillow shape) may be created by band sawing the tapered shape through one side of block/stack 400 to achieve tapering in two sides of the pillow and then band sawing the tapered shape through a second side of block/stack 400 to achieve tapering in the other two sides of the pillow. Non-rectangular foam cushions could also be created using the technique represented in FIG. 4 by first cutting a rectangular block as shown in FIG. 4, then milling the cushion to final shape, for example, with a CNC mill.

Figure 8:
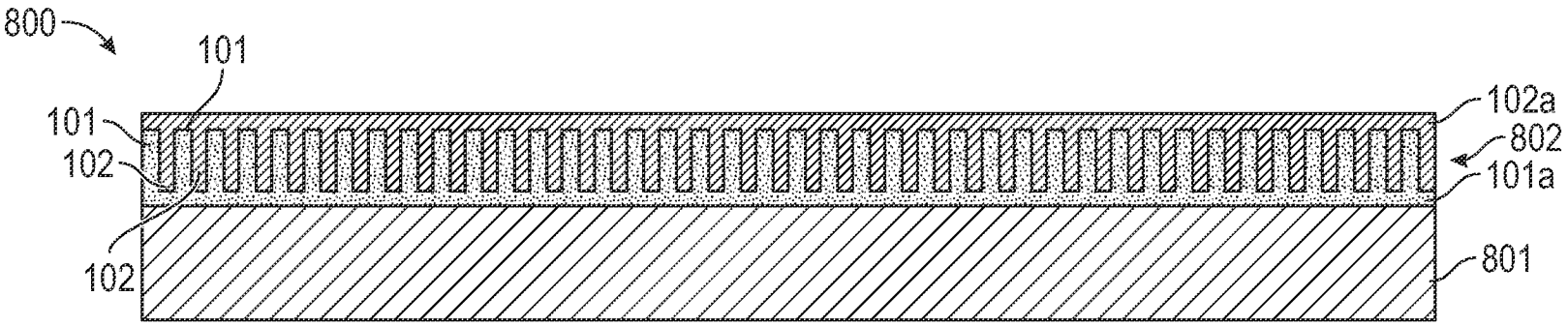
FIG. 8 provides an example of a mattress that includes a foam cushion formed of opposing foam cushion components in accordance with one or more embodiments of the present invention.

FIG. 8 provides an example of a mattress 800 that is configured in accordance with one or more embodiments of the present invention. Mattress 800 includes a base layer 801 and foam cushion 802 that, like foam cushions 100, 200 and 300, includes alternating layers 101 and 102. However, unlike in foam cushions 100, 200 and 300, layers 101 and 102 in foam cushion 802 emanate from bases 101*a* and 102*a* respectively. In some embodiments, base 101*a* and each layer 101 may be a unitary piece of foam (or "foam cushion component") and base 102*a* and each layer 102 may be a separate foam cushion component. In foam cushion 802, base 101*a* and base 102*a* have the same height (or vertical thickness) ($B_H$ as labeled in FIG. 12C) and all layers 101 and 102 have the same height ($L_H$ as labeled in FIG. 12C). However, in other embodiments, base 101*a* and base 102*a* could have different heights and/or layers 101 and layers 102 could have different heights.

Figure 9:
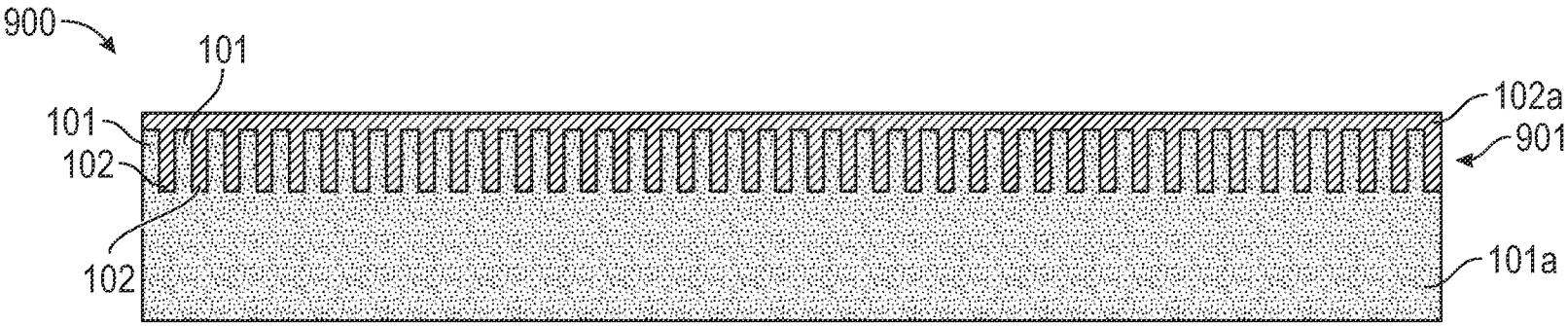
FIG. 9 provides another example of a mattress that includes a foam cushion formed of opposing foam cushion components in accordance with one or more embodiments of the present invention.

FIG. 9 provides an example of a mattress 900 that is configured in accordance with one or more embodiments of the present invention. Mattress 900 includes only a foam cushion 901. Foam cushion 901 is the same as foam cushion 802 except that, in foam cushion 901, base 101*a* has a substantially greater height than base 102*a*. For example, the height of base 101*a* can be increased so that base 101*a* can function as a base layer for mattress 900.

Figure 10A:
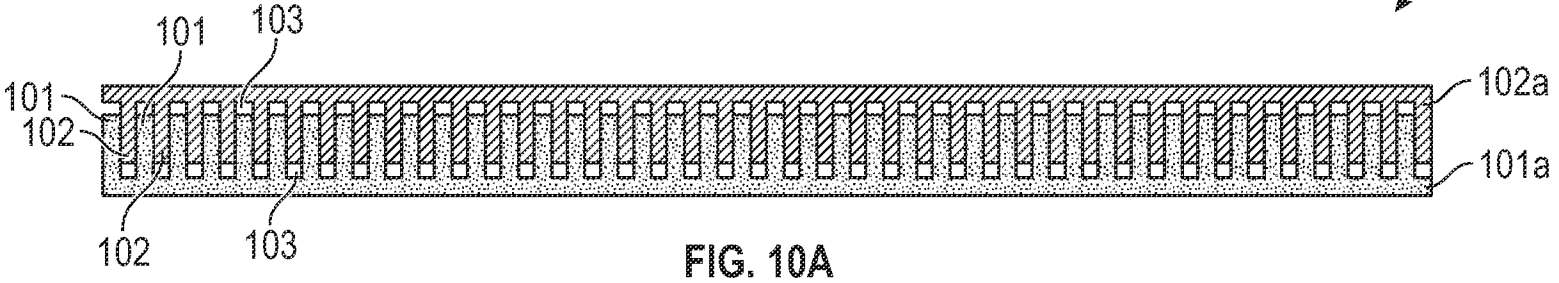
FIGS. 10A-10C provide examples of foam cushions formed of opposing foam cushion components that also include gaps.
Figure 10B:
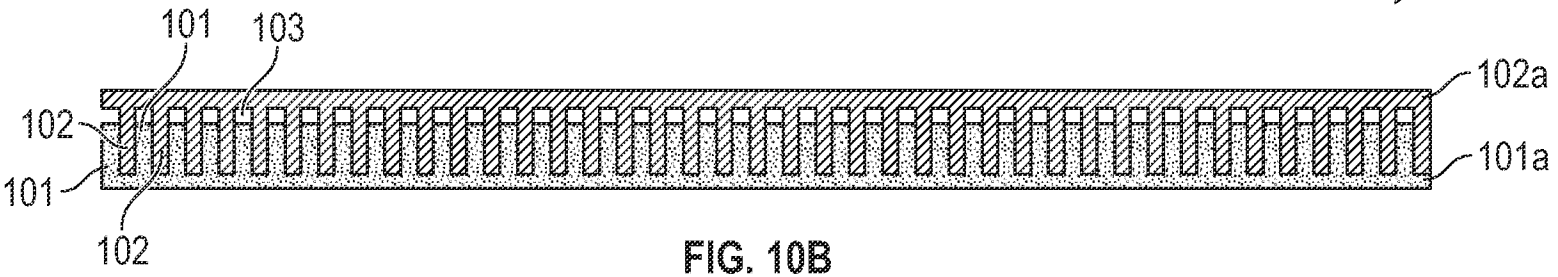
Figure 10C:
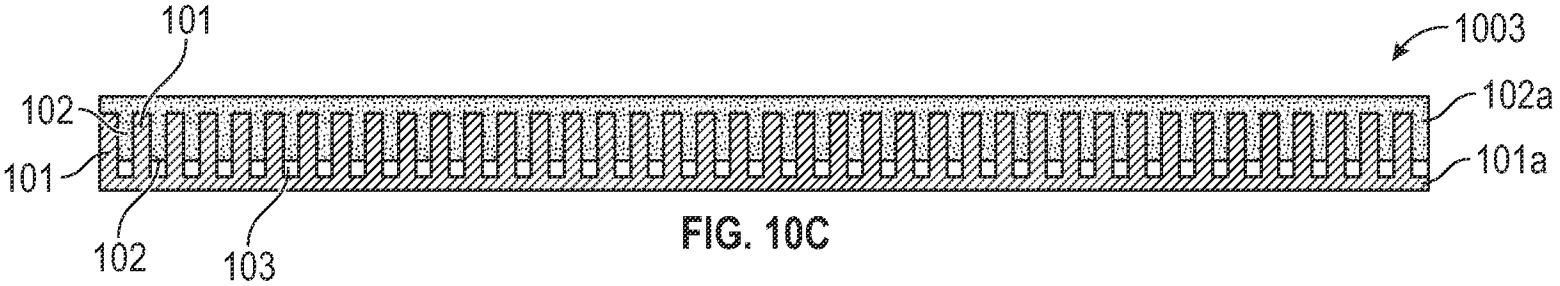

FIGS. 10A-10C provide additional examples of foam cushions 1001-1003 respectively that are similar to foam cushion 802 but include gaps 103. In foam cushion 1001, gaps 103 are formed between layers 101 and base 102*a* and between layers 102 and base 101*a*. This may be accomplished by gluing or otherwise adhering layers 101 to layers 102 without fully inserting the layers between one another.

In foam cushion 1002, gaps 103 are only formed between layers 101 and base 102*a*. This may be accomplished by configuring layers 102 to have a greater height than layers 101 such that, even with layers 101 fully inserted between layers 102, gaps 103 will still be formed.

Foam cushion 1003 is similar to foam cushion 1002 except that gaps 103 are formed between layers 102 and base 101*a*. This may be accomplished by configuring layers 101 to have a greater height than layers 102 such that, even with layers 102 fully inserted between layers 101, gaps 103 will still be formed.

Figure 11:
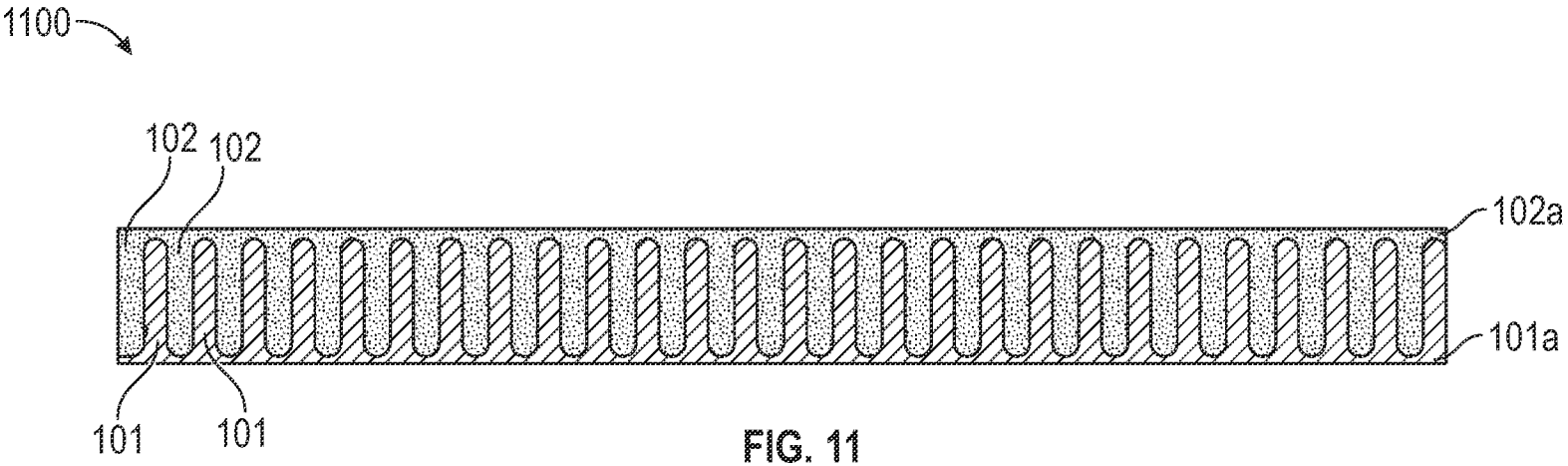
FIG. 11 provides an example of a foam cushion formed of opposing foam cushion components where the layers have rounded ends in accordance with one or more embodiments of the present invention.

FIG. 11 provides an example of a foam cushion 1100 that includes layers 101 and 102 that emanate from bases 101*a* and 102*a* respectively as described above (i.e., foam cushion 1100 is formed of opposing foam cushion components). Unlike in previous examples, the ends of layers 101 and 102 are rounded and the portion of bases 101*a* and 102*a* between layers 101 and 102 respectively are correspondingly rounded. In some embodiments, layers 101 and 102 can be coupled together by gluing only the rounded ends, while in other embodiments, glue may be applied along the entire interface between the layers.

Figure 12A:
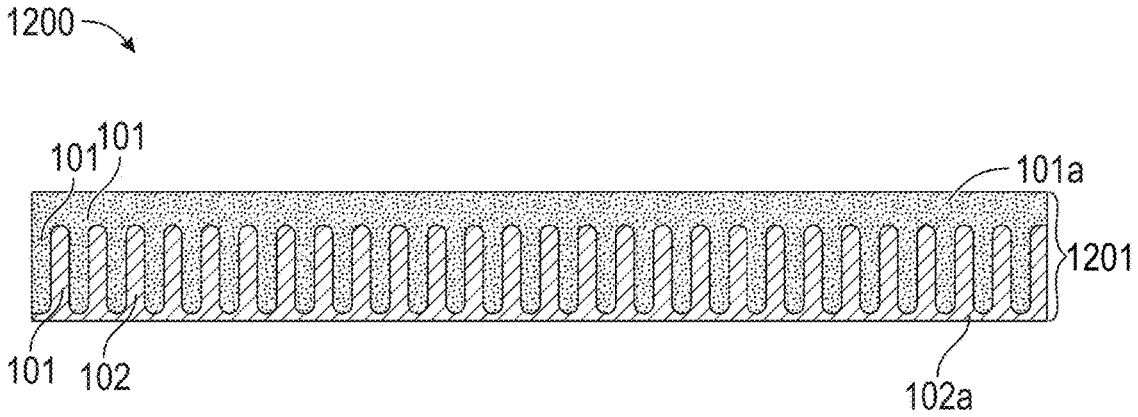
FIGS. 12A-12C provide an example of a mattress that includes single foam cushion formed of opposing foam cushion components in accordance with one or more embodiments of the present invention.
Figure 12B:
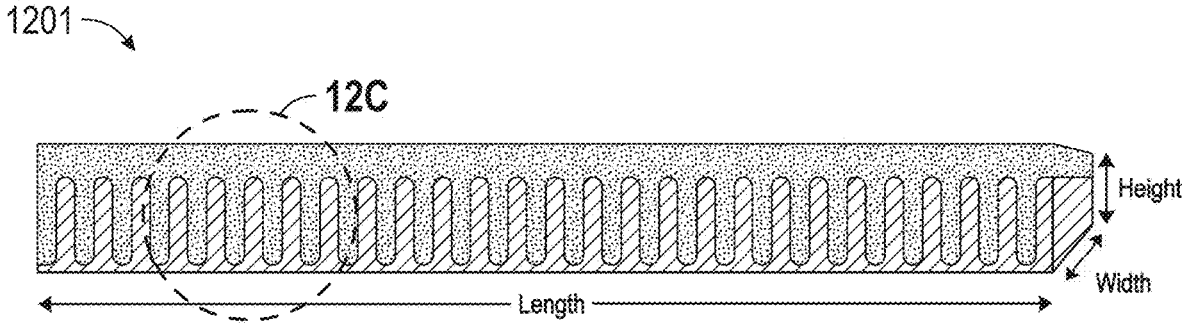
Figure 12C:
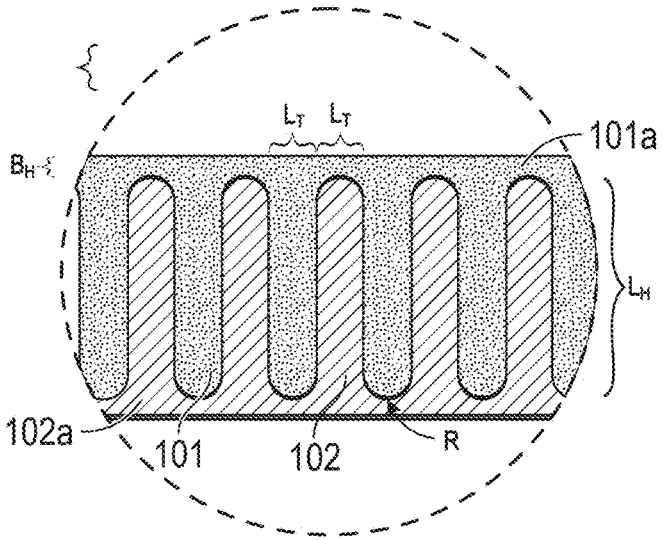

FIGS. 12A-12C provide an example of a mattress 1200 that is formed of a single foam cushion 1201. Foam cushion 1201 is the same as foam cushion 1100 except that base 102*a* has a greater height than base 101*a*. FIG. 12C provides examples of suitable dimensions that foam cushion 1201 could have. However, any other reasonable dimensions could be used. In this example, layers 101 and 102 have a thickness ($L_T$) of approximately 1.4815 inches and the rounded ends have a radius (R) of approximately 0.7407 inches. Layers 101 and 102 have a height ($L_H$) of approximately 7.000 inches, while bases 101*a* and 102*a* may have heights of approximately 0.500 inches and 2.500 inches respectively. Accordingly, the height of foam cushion 1201/mattress 1200 is approximately 10.000 inches.

FIGS. 13A-13E provide an example of a mattress 1300 that is formed of a foam cushion 1301 that is positioned on top of a foam cushion 1302. Foam cushions 1301 and 1302 each include opposing foam cushion components.

Figure 13A:
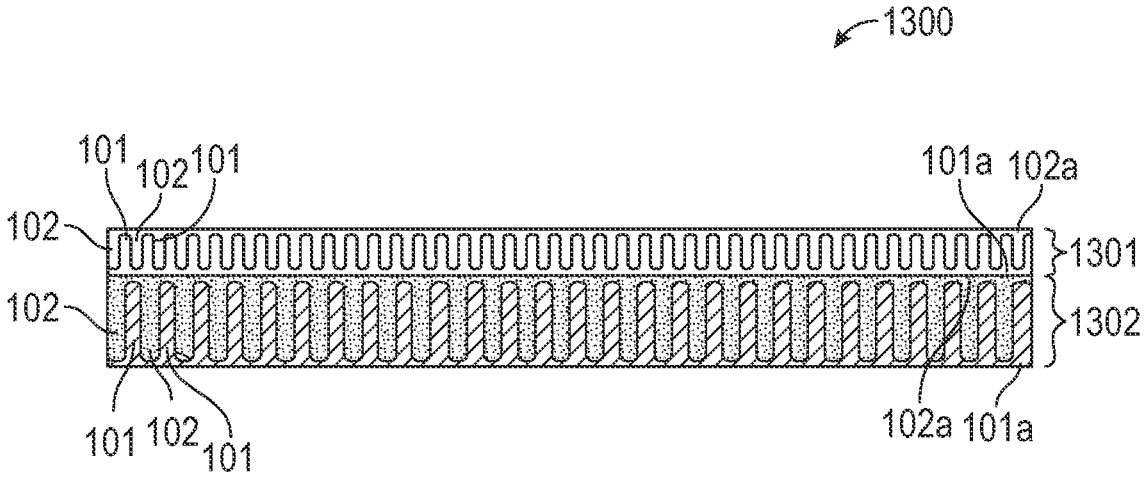
FIGS. 13A-13E provide an example of a mattress that includes a two foam cushions that are each formed of opposing foam cushion components in accordance with one or more embodiments of the present invention.
Figure 13B:
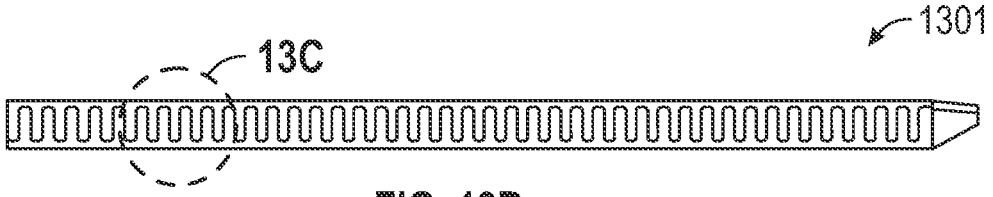
Figure 13C:
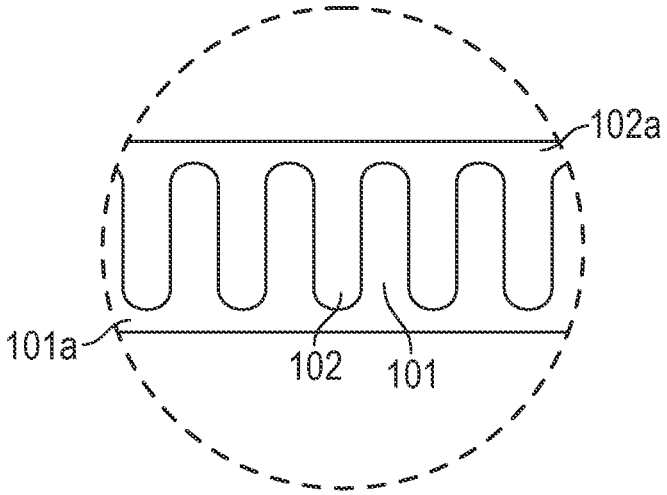

FIGS. 13B and 13C show foam cushion 1301 in isolation and provide suitable dimensions. However, any other reasonable dimensions could be used. In this example, layers 101 and 102 have a width of approximately 1.000 inches and the rounded ends have a radius of approximately 0.500 inches. Layers 101 and 102 have a height of approximately 3.000 or 4.000 inches and bases 101*a* and 102*a* have a height ($B_H$) of approximately 0.500 inches. Accordingly, the height of foam cushion 1301 may be approximately 4.000 inches or 5.000 inches.

Figure 13D:
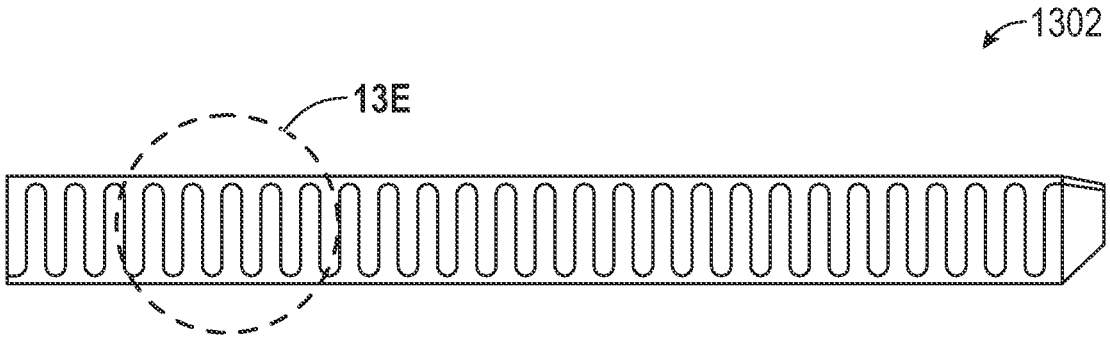
Figure 13E:
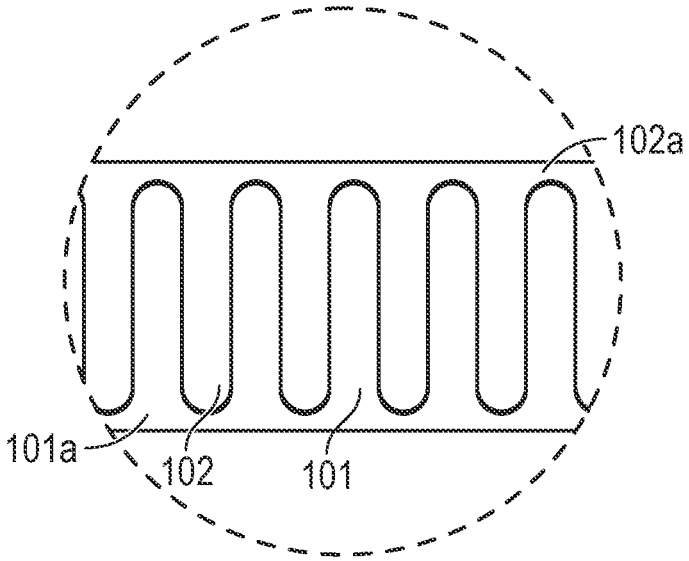

FIGS. 13D and 13E show foam cushion 1302 in isolation and provide suitable dimensions. However, any other reasonable dimensions could be used. In this example, layers 101 and 102 have a width of approximately 1.4815 inches and the rounded ends have a radius of approximately 0.7407 inches. Layers 101 and 102 have a height of approximately 7.000 inches and bases 101*a* and 102*a* have a height of approximately 0.500 inches. Accordingly, the height of foam cushion 1302 may be approximately 8.000 inches and height of mattress 1300 may be approximately 12.000 inches or 13.000 inches.

With each of the foam cushions formed of opposing foam cushion components, the type of foam for the top foam cushion component and for the bottom foam cushion component can be selected to provide one or more desired benefits. For example, the top foam cushion component can be formed of a more breathable foam than the bottom foam cushion component to enhance breathability. In contrast, the top foam cushion component could be formed of memory foam, which is less breathable, while the bottom foam cushion component could be formed of a more breathable foam. In such cases, the more breathable foam of the bottom foam cushion component can enhance the breathability of the less breathable foam of the top foam cushion component. This may be because the layers of the bottom foam cushion component extend up towards and are positioned close to the base of the top foam cushion component, so that heat does not need to convect very far through the less breathable foam to reach the more breathable foam.

Figure 14:
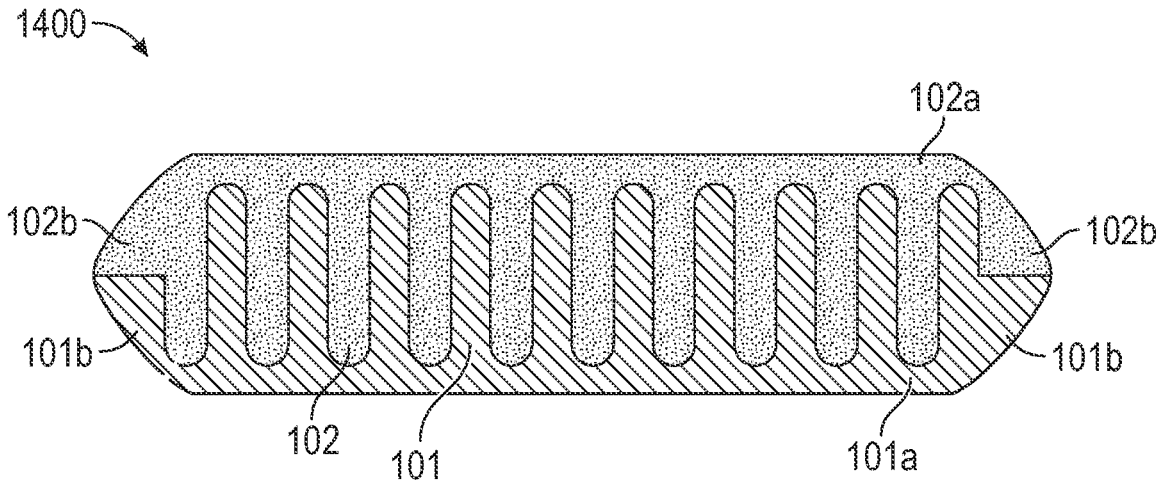
FIG. 14 provides an example of a pillow that is formed of opposing foam cushion components in accordance with one or more embodiments of the present invention.

FIG. 14 provides an example of a foam cushion 1400 that is in the form of a pillow. Foam cushion 1400 is formed by opposing foam cushion components configured in a similar manner as described above. Additionally, bases 101*a* and 102*a* each include tapered extensions 101*b* and 102*b* respectively that extend parallel to layers 101 and 102 to form the pillow shape.

Figure 15A:
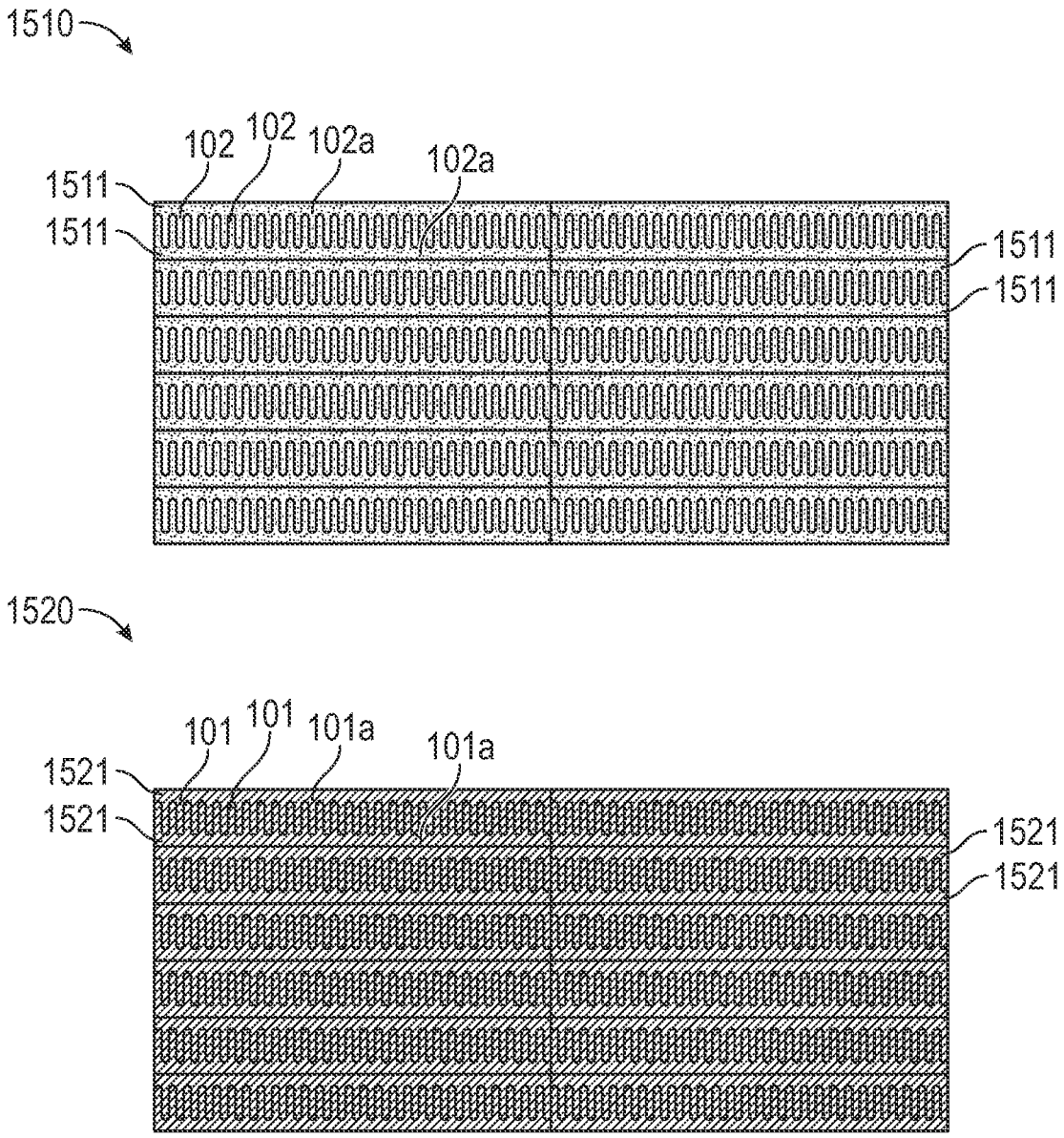
FIGS. 15A and 15B provide an example of how foam cushions can be formed from opposing foam cushion components.
Figure 15B:
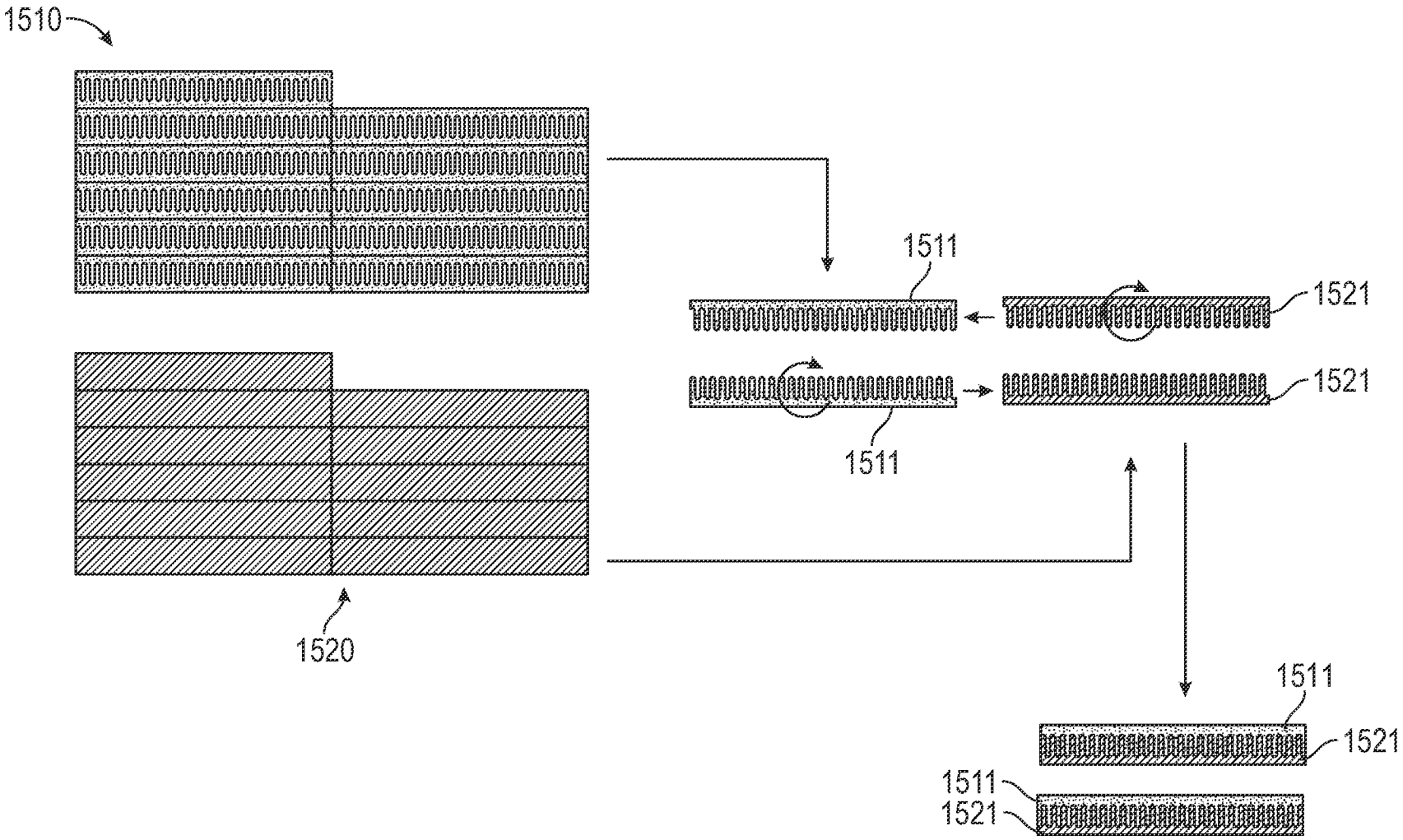

FIGS. 15A and 15B provide an example of how foam cushions could be produced in accordance with one or more embodiments of the present invention. FIG. 15A shows a first piece of foam 1510 and a second piece of foam 1520. Foam 1510 and foam 1520 may be different types of foam and may be sized and shaped to allow multiple foam cushion components 1511 and 1521 respectively to be cut out from them. For example, foam 1510 and 1520 may have rectangular dimensions that are a multiple of the desired dimensions of a mattress to be produced. In FIG. 15A, the length of foam 1510 and 1520 is two times the desired length of the mattress, the width is presumably the same as the desired width of the mattress, and the height is six times the desired height of the mattress (which is the case in this example because foam cushion components 1511 and 1521 have the same height). FIG. 15A also shows how foam cushion components 1511 and 1521 can be cut out from foam 1510 and 1520 respectively. In some embodiments, foam cushion components 1511 can be cut from foam 1510 and foam cushion components 1521 can be cut from foam 1520 using a single CNC saw-cut program.

FIG. 15B shows how a pair of opposing foam cushion components 1511 and a pair of opposing foam cushion components 1521 can be removed from foam 1510 and 1520 respectively and then separated from one another. One of foam cushion components 1511 and one of foam cushion components 1521 can be flipped and then a foam cushion component 1511 and a foam cushion component 1521 can be coupled together. In some embodiments, this coupling can be performed in a zipper fashion. In particular, layers 101 and 102 at one end of foam cushion components 1521 and 1511 respectively can initially be inserted together followed by the next layers 101 and 102 until all the layers 101 and 102 have been combined. In some embodiments, glue or another adhesive may be placed at least on the ends of layers 101 and 102 prior to zippering the layers together in this manner.

Although FIGS. 15A and 15B represent the production of foam cushions having a rectangular shape (e.g., for mattresses), the same production technique could be used to produce foam cushions with other shapes (e.g., foam cushion 1400).

In some embodiments, a lubricant may be used during the process of assembling foam cushion components. For example, the ends (whether or not rounded) of layers 101 and 102 may be coated with a lubricant to facilitate insertion of the layers between one another. In embodiments where an adhesive is used, the lubricant could be added to the adhesive and then the mixture of adhesive and lubricant can be applied to the ends of the layers 101 and 102. In some embodiments, the adhesive could be water based (e.g., Simalfa 350) and the lubricant could also be water based (e.g., KY Jelly). In some embodiments, the mixture adhesive and lubricant could include 10% lubricant by volume, 20% lubricant by volume, or 50% lubricant by volume. In some embodiments, the lubricant may reduce the rate of evaporation of the adhesive and may therefore prolong the working time of the adhesive (i.e., the lubricant may slow the drying of the adhesive). This may particularly beneficial for assembling foam cushion components, such as foam cushion components 1511 and 1521, which can require a substantial amount of time to perform the zippering.

In embodiments in which glue (or other adhesive) is used to couple layers together, instability of the layers may be controlled by applying glue only at or near the tops and/or bottoms of the layers as opposed to along the full interface between the layers. In this way, layers that are intended to be unstable (e.g., those with higher IFDs) can more easily collapse due to the reduced length along which they are coupled to the adjacent layer. As described above, this designed instability can cause a mattress (or other cushioning article) to give in response to substantial pressure (e.g., at the hip or shoulder) while the remainder of the mattress provides firm support.

Experiments and Results

Various experiments were performed on the different types of foam cushions described herein and different configurations of such foam cushions. The results of these experiments are summarized below.

Various foam cushions matching the configuration shown in FIGS. 1A and 1B (e.g., layers 101 and 102 were made of foams A and B respectively) were tested as foam cushions for mattresses. In each test, the foam cushions were placed on a base consisting of 1" 32 ILD conventional polyurethane foam atop an 8" pocketed coil spring. FIG. 16 is a table that summarizes the results of these tests. The results illustrate that different synergistic results can be obtained from using the layered arrangement of different foams.

Various foam cushions generally corresponding to the configurations shown in FIG. 11 were tested as foam cushions for mattresses. In tests 14 and 15, no base was used. In test 16, the foam cushion was tested as the base of a mattress. FIG. 17 is a table that summarizes the results of these tests. The results illustrate that different synergistic results can be obtained from using the layered arrangement of different foams.

Various mattresses generally corresponding to the configurations shown in FIG. 12A-13E were also tested. In each test, the foam cushion of test 16 or a variation was used as the base foam cushion. FIG. 18 is a table that summarizes the results of these tests. The results illustrate that different synergistic results can be obtained from using the layered arrangement of different foams in both the top foam cushion and the bottom foam cushion.

Various pillows generally corresponding to the configurations shown in FIG. 14 were also tested. FIG. 19 is a table that summarizes the results of these tests. The results illustrate that different synergistic results can be obtained from using the layered arrangement of different foams.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description.

What is claimed:

1. A cushioning article comprising:

a first foam cushion comprising:

a first foam cushion component having a first base and first layers that emanate from the first base;

a second foam cushion component having a second base and second layers that emanate from the second base;

wherein the first layers are alternated with and positioned between the second layers along a length of the cushioning article;

wherein each layer of the first and second foam cushion components has a height and a thickness, and wherein a ratio of the height to the thickness is at least 2.5, the ratio being selected to enable collapsing of individual layers in response to a compressive load;

wherein, in response to a compressive load, individual layers are configured to collapse in a lateral direction relative to the compressive load, thereby causing adjacent layers to separate and define spaces therebetween.

2. The cushioning article of claim 1, further comprising: a base layer on which the first foam cushion is positioned.

3. The cushioning article of claim 1, wherein the first and second layers are formed of different types of foam.

4. The cushioning article of claim 3, wherein the different types of foam have Indentation Force Deflections (IFDs) that differ by at least 15%.

5. The cushioning article of claim 3, wherein the different types of foam have Indentation Force Deflections (IFDs) that differ by at least 20%.

6. The cushioning article of claim 3, wherein the different types of foam have Indentation Force Deflections (IFDs) that differ by at least 25%.

7. The cushioning article of claim 3, wherein the different types of foam are selected from:

quick-rebound polyurethane foam;
slow-rebound polyurethane foam;
latex foam;
expanded polyolefin foam;
EVA foam;
silicone foam;
melamine foam;
PVDF foam;
polyethylene foam;
shredded and then rebonded foam; and
Energex foam.

8. The cushioning article of claim 1, wherein the first base and the second base have the same height.

9. The cushioning article of claim 1, wherein the first base has a different height than the second base.

10. The cushioning article of claim 1, wherein the height of the first layers and the height of the second layers are the same.

11. The cushioning article of claim 1, wherein the height of the first layers is different than the height of the second layers.

12. The cushioning article of claim 1, wherein gaps are formed between the first layers and the second base.

13. The cushioning article of claim 12, wherein the second layers extend to the first base.

14. The cushioning article of claim 12, wherein gaps are also formed between the second layers and the first base.

15. The cushioning article of claim 14, wherein the height of the first layers and the height of the second layers are the same.

16. The cushioning article of claim 1, wherein the ends of the first and second layers are rounded.

17. The cushioning article of claim 16, wherein portions of the first and second bases between the first and second layers respectively are rounded.

18. The cushioning article of claim 1, wherein the first layers and first base are unitarily formed and the second layers and second base are unitarily formed.

19. The cushioning article of claim 1, wherein the first foam cushion component is positioned above the second foam cushion component, and wherein a height of the first base is greater than a height of the second base.

20. The cushioning article of claim 19, wherein the height of the first base is approximately 2.5 inches and the height of the second base is approximately 0.5 inches.

21. The cushioning article of claim 20, wherein a height of the first and second layers is approximately 7.0 inches.

22. The cushioning article of claim 21, wherein ends of the first and second layers are rounded and have a radius of approximately 0.75 inches.

23. The cushioning article of claim 1, wherein the first and second bases include tapered extensions that extend parallel to first and second layers respectively.

24. The cushioning article of claim 1, further comprising: a second foam cushion, wherein the first foam cushion is positioned on top of the second foam cushion.

25. The cushioning article of claim 24, wherein the second foam cushion comprises:

a third foam cushion component having a third base and third layers that emanate from the third base;

a fourth foam cushion component having a fourth base and fourth layers that emanate from the fourth base;

wherein the third layers are alternated with and positioned between the fourth layers.

26. The cushioning article of claim 25, wherein a height of the first foam cushion component is different than a height of the second foam cushion component.

27. The cushioning article of claim 26, wherein the height of the first foam cushion component is less than the height of the second foam cushion component.

28. The cushioning article of claim 25, wherein ends of the first, second, third and fourth layers are rounded.

29. The cushioning article of claim 25, wherein each layer of the third and fourth foam cushion component has a height and a thickness, and wherein a ratio of the height to the thickness is at least 2.5.

30. The cushioning article of claim 1, wherein the cushioning article is a mattress.

31. The cushioning article of claim 1, wherein the cushioning article is a pillow.

32. The cushioning article of claim 1, wherein an adhesive is applied between the first and second layers only to ends of one or both of the first and second layers to thereby enable the first and second layers to collapse.

33. The cushioning article of claim 1, wherein the first layers are not unitarily formed with the first base.

34. The cushioning article of claim 1, wherein the first foam cushion has a non-rectangular cross-sectional shape.

35. A cushioning article comprising:

a first foam cushion comprising opposing first and second foam cushion components, each of the first and second foam cushion components including layers that emanate from a base and the layers of the first foam cushion component are alternated with the layers of the second foam cushion component along a length of the cushioning article;

wherein each layer of the first and second foam cushion components has a height and a thickness, and wherein a ratio of the height to the thickness is at least 2.5;

wherein an adhesive is applied between each layer of the first and second foam cushion components only to ends of the layers to thereby enable the layers to collapse.

36. The cushioning article of claim 35, further comprising:

a second foam cushion comprising opposing third and fourth foam cushion components, each of the third and fourth foam cushion components including layers that emanate from a base and the layers of the third foam cushion component are alternated with the layers of the fourth foam cushion component along the length of the cushioning article, the first foam cushion being positioned on top of the second foam cushion;

wherein each layer of the third and fourth foam cushion components has a height and a thickness, and wherein a ratio of the height to the thickness is at least 2.5.

37. The cushioning article of claim 36, wherein the height of the layers of the first and second foam cushion components is less than the height of the layers of the third and fourth foam cushion components.

38. The cushioning article of claim 36, wherein the layers of the first, second, third and fourth foam cushion components are each made of a different type of foam.

39. The cushioning article of claim 35, further comprising:

a base layer on which the first foam cushion is positioned.

40. The cushioning article of claim 39, wherein the base layer is a unitary piece of foam.

41. The cushioning article of claim 35, wherein the base of the first foam cushion component is not unitarily formed with the layers of the first foam cushion component.

42. The cushioning article of claim 35, further comprising:

a second foam cushion, the first foam cushion being positioned on top of the second foam cushion.

43. The cushioning article of claim 35, wherein the layers of the first and second foam cushion components are formed of different types of foam.

44. The cushioning article of claim 43, wherein the different types of foam have different IFDs.

45. The cushioning article of claim 35, wherein the base and layers of the second foam cushion component are unitarily formed and the base of the first foam cushion component is not unitarily formed with the layers of the first foam cushion component, and wherein the base of the second foam cushion component is positioned below the base of the first foam cushion component.

46. A method for assembling a cushioning article, the method comprising:

obtaining a first foam cushion component, the first foam cushion component having a first base and first layers that emanate from the first base;

obtaining a second foam cushion component, the second foam cushion component having a second base and second layers that emanate from the second base; and inserting the first layers of the first foam cushion component between the second layers of the second foam cushion component to form a first foam cushion of the cushioning article such that the first lavers are alternated with and positioned between the second layers along a length of the cushioning article;

wherein each layer of the first and second foam cushion components has a height and a thickness, and wherein a ratio of the height to the thickness is at least 2.5, the ratio being selected to enable collapsing of individual lavers in response to a compressive load:

wherein, in response to a compressive load, individual layers are configured to collapse in a lateral direction relative to the compressive load, thereby causing adjacent layers to separate and define spaces therebetween.

47. The method of claim 46, wherein the first layers and first base are unitarily formed and the second layers and second base are unitarily formed.

48. The method of claim 46, further comprising:

applying an adhesive between the first and second layers only to ends of one or both of the first and second layers to thereby enable the first and second layers to collapse.

49. The method of claim 48, wherein the ends of the first and second layers are rounded.

50. The method of claim 46, wherein the first layers are not unitarily formed with the first base.

51. The method of claim 48, wherein the height of the first layers and the height of the second layers are the same.

52. The method of claim 46, wherein the first and second layers are formed of different types of foam.

53. The method of claim 52, wherein the different types of foam have Indentation Force Deflections (IFDs) that differ by at least 15%.

54. The method of claim 46, wherein the first foam cushion has a non-rectangular cross-sectional shape.

* * * * *